US007069825B2

(12) United States Patent
Cheung

(10) Patent No.: US 7,069,825 B2
(45) Date of Patent: Jul. 4, 2006

(54) CORKSCREW

(75) Inventor: Chun Ming Cheung, Hong Kong (HK)

(73) Assignee: Technical Development (HK) Limited, Hong Kong (HK)

( * ) Notice: Subject to any disclaimer, the term of this patent is extended or adjusted under 35 U.S.C. 154(b) by 0 days.

(21) Appl. No.: 11/172,687

(22) Filed: Jun. 30, 2005

(65) Prior Publication Data

US 2006/0112787 A1 Jun. 1, 2006

(30) Foreign Application Priority Data

| | | | |
|---|---|---|---|
| Nov. 26, 2004 | (GB) | ..... | 0425959.4 |
| Mar. 18, 2005 | (GB) | ..... | 0505459.8 |
| Apr. 12, 2005 | (GB) | ..... | 0507367.1 |

(51) Int. Cl.
*B67B 7/62* (2006.01)

(52) U.S. Cl. ..... 81/337; 81/3.09; 81/3.39

(58) Field of Classification Search ..... 81/3.09, 81/3.29, 3.36, 3.39, 3.45, 3.47, 3.55, 3.56, 81/3.48, 337; 7/155, 156
See application file for complete search history.

(56) References Cited

U.S. PATENT DOCUMENTS

| | | | | |
|---|---|---|---|---|
| 4,063,473 A * | 12/1977 | Bozzo | ..... | 81/3.37 |
| 4,765,206 A * | 8/1988 | Poehlmann | ..... | 81/3.37 |
| 5,367,923 A | 11/1994 | Fabbro | | |
| 5,934,160 A | 8/1999 | Gibson | | |
| 6,357,322 B1 * | 3/2002 | Dolan et al. | ..... | 81/3.37 |
| 2002/0174489 A1 | 11/2002 | Pulg | | |

FOREIGN PATENT DOCUMENTS

| | | |
|---|---|---|
| DE | 696 14 254 T2 | 10/1996 |
| GB | 2 127 795 A | 4/1984 |
| GB | 2 304 703 | 3/1997 |
| GB | 2 399 566 | 9/2004 |
| GB | 0425959.4 | 5/2005 |
| WO | WO 96/15062 | 5/1996 |
| WO | WO 01/70620 A1 | 9/2001 |
| WO | WO 2004/083101 A1 | 9/2004 |

* cited by examiner

*Primary Examiner*—Lee D. Wilson
*Assistant Examiner*—Anthony Ojini
(74) *Attorney, Agent, or Firm*—Daniel B. Schein, Esq.

(57) ABSTRACT

A corkscrew comprising a body and a handle,
the body including a socket adapted to receive the neck of a bottle sealed by a cork,
an actuation lever,
an axially rotatable worm spiral mounted on a carriage within the body and arranged to rotate and penetrate the cork as the lever is lowered, the spiral being further arranged to cease rotation as the lever is raised to withdraw the cork from the bottle,
the corkscrew being further arranged to discharge the cork from the screw by lowering and raising the lever after the neck of the bottle has been removed from the socket.

15 Claims, 38 Drawing Sheets

CORKSCREW

BACKGROUND TO THE INVENTION

This invention relates to a corkscrew which may be used for removing a cork from a bottle, for example a bottle of wine, vegetable oil or other liquid.

There are many designs of corkscrews wherein a sharpened worm screw extends from a handle or lever mechanism. Such corkscrews can be dangerous in use and may require dexterity and manual strength in their operation.

It is an object of the present invention to provide a corkscrew which overcomes these disadvantages.

In this specification references to upward and downward are intended to refer to the corkscrew as used with respect to an upright bottle, that is with the proximal region uppermost and the distal region in contact with the bottle neck.

DESCRIPTION OF THE PRIOR ART

GB-A-2399566 discloses a corkscrew comprising a body and a handle, the body including a socket adapted to receive the neck of a bottle sealed by a cork, an actuation lever, an axially rotatable worm spiral mounted on a carriage within the body and arranged to rotate and penetrate the cork as the lever is lowered, the spiral being further arranged to cease rotation as the lever is raised to withdraw the cork from the bottle, the corkscrew being further arranged to discharge the cork from the screw by lowering and raising the lever after the neck of the bottle has been removed from the socket.

SUMMARY OF THE INVENTION

According to the present invention there is a provided a corkscrew comprising a body and a handle, the body including a socket adapted to receive the neck of a bottle sealed by a cork, an actuation lever, an axially rotatable worm spiral mounted on a carriage within the body and arranged to rotate and penetrate the cork as the lever is lowered, the spiral being further arranged to cease rotation as the lever is raised to withdraw the cork from the bottle, the corkscrew being further arranged to discharge the cork from the screw by lowering and raising the lever after the neck of the bottle has been removed from the socket;

wherein the carriage is mounted for movement between upper and lower positions along one or more, preferably two, guide runners extending longitudinally of the body, the spiral being connected to the carriage by a bearing so that the spiral is rotatable with respect to the carriage, and further comprising a guide member having an aperture, the screw extending through the guide member, the aperture being adapted to cause the screw to rotate as the screw moves axially through the guide member, first latch means being adapted to releasably engage the guide member to the corkscrew body, and second latch means being adapted to releasably engage the guide member to the carriage, the first latch member being moveable from a closed position to an open position by insertion of a bottle neck into the socket, wherein in the closed position the first latch member may engage the guide member and wherein in the open position the first latch member disengages the guide member, and wherein the first latch member in the closed position prevents engagement of the second latch member to the guide member.

In a preferred corkscrew the guide member includes one or more engagement members having a surface arranged to cooperate with the second latch member to form a releasable catch.

In particularly preferred embodiments the engagement member comprises a protrusion extending, for example radially outwardly, from the carriage and arranged to be received in an aperture or socket of the second latch member. Advantageously the protrusion may comprise a pin or stud and the second latch member may comprise a plate having an aperture dimensioned to receive the pin or stud.

In particularly preferred corkscrews the first latch member includes a tongue having a lead edge which extends upwardly to cooperate with the protrusion to prevent engagement of the protrusion and the second latch member.

Preferably the tongue includes an upwardly opening rebate dimensioned to receive the protrusion. In this embodiment the head of the protrusion may be located within the tongue of the first latch member so that the protrusion cannot enter or engage the aperture of the second latch member.

In this way the carriage cannot engage the guide member unless a bottle is inserted into the socket so that the spiral rotates as the handle is raised or lowered. However when the carriage and guide member are engaged after a cork has been withdrawn from a bottle and the neck of the bottle has been removed and the handle is lowered, the leading edge of the tongue of the first member passes between the carriage and second latch member to disengage the carriage and latch member.

In a preferred embodiment of the invention, the spiral is wholly contained within the body and thereby shielded by the body during all stages of use to remove a cork. This reduces the likelihood of injury to a user. The corkscrew of this invention may efficiently remove the cork from a bottle and then release the cork from the spiral without use of excessive force or any need for dexterity by a user. The corkscrew is therefore easy and quick to use. Use by elderly, infirm or disabled persons is facilitated.

The present invention provides an improvement on previously disclosed corkscrews. The construction is robust and uses a small number of moving parts or metal components. Furthermore the mechanism will operate correctly even if the bottle is not inserted correctly into the socket, for example if the neck of the bottle is inserted at an angle. Actuation of a corkscrew in accordance with this invention requires less precision. The corkscrew is smaller, lighter and quieter in use.

The aperture may have a helical threaded bore adapted to receive the helical screw, permitting the screw to rotate as the guide member moves axially relative to the screw.

Preferably two or more of each of the first and second latch means are disposed on opposite sides of the corkscrew axis, or where more than two are present, symmetrically distributed around the axis.

When the first latch means is dis-engaged the guide member and carriage may move together so that the spiral screw may be raised by the actuation lever without rotation of the screw, allowing a cork to be withdrawn from a bottle.

In a second preferred embodiment of the invention the latch member extends upwardly from a point of attachment to the corkscrew body, being biassed radially inwardly by a spring.

The second latch means is preferably actuated by the first latch means. When the first latch is in the closed position, the second latch is opened during downward movement of the carriage releasing the carriage for movement independently of the guide member and also engaging the guide member with the first latch member. In this state, the spiral screw is caused to pass through the guideway and rotate when the carriage is subsequently raised and lowered by the actuation lever.

In preferred embodiments of the invention the first latch member extends upwardly from an horizontal pivot mounted on the main body of the corkscrew, for example, on the guideway member. In a first embodiment the horizontal pivot is mounted on the guideway member. A spring is provided to bias the upper portion of the latch member radially inwardly towards the closed position. The upper portion of the latch member may be provided with radially inwardly and outwardly facing cam surfaces. These cam surfaces may meet at a uppermost pointed or narrow leading edge, arranged to contact and co-operate with a flange or other contact surface of the second latch member as the carriage is lowered.

In the first aspect of the first embodiment a radially inwardly extending contact surface provided by a lower protrusion or foot is located at a lower part of the latch member. Engagement of the contact surface with an upwardly moving part of the actuator or neck engaging portion causes the latch to rotate about the horizontal pivot, moving the upper portion radially outwardly against the action of the spring.

In a first embodiment of the invention, two or more preferably four resilient members extend upwardly from the actuator or neck engaging portion. The or each resilient member has a tooth which can engage a respective tooth or other complimentary formation in the guideway member to lock the actuator in its upper location. Downward movement of the neck engaging portion due to the action of the spring and first latch member is thereby prevented. In this situation the latch remains in an open and armed condition. Insertion of the neck of a bottle into the body of the corkscrew thus moves the first latch member into the armed condition.

When the first latch member is in the armed condition the second latch member contacts and engages the radially inner surface of the latch as the handle is moved downwards. As the carriage approaches the lower extent of the range of movement, the downwardly extending members of the carriage engage the resilient members of the actuator or neck engaging portion, urging the resilient members out of engagement with the complimentary formations of the guideway member. In this way the guideway member is released to move downwardly and the first latch member is released to be moved inwardly by the spring.

In a second embodiment the teeth and preferably all of the four resilient members are omitted so that neck engaging position does not engage and become locked to the guideway member.

In the first embodiment the first latch member includes an upper radially inwardly facing projection, for example a hook or tooth, located above the pivot. This upper projection includes a downwardly facing surface. The carriage includes a radially outwardly facing projection or other formation providing a radially outwardly extending and upwardly facing surface adapted to engage the upper projection of the first latch member when the guideway is at the lower position of its range of movement. In this way the latch engages the guide member locking the guide member to the latch or to the neck engaging portion of the sleeve and hence to the main body of the corkscrew. Vertical movement of the guide member is thus prevented.

In the third preferred embodiment two or more latch members extend into the bottle neck receiving socket of the corkscrew having shoulders to engage the upper surface of the bottle neck as the bottle is inserted into the socket so that the latch members are forced outwardly by insertion of a bottle neck into the socket.

In the third embodiment the first latch member also includes an upper radially inwardly extending projection for example a hook or tooth, located above the pivot. However, the body of the latch member is generally elongate extending upwardly from a pin or other pivot or mounting at a lower portion, to the projection at an upper portion. An intermediate portion of the body between the mounting and hook comprises a cam or engagement surface adapted to be urged radially outwardly by the upward insertion of the bottle neck into the corkscrew body. The cam surface may either engage the bottle neck directly or may contact the actuator so that it is urged outwardly by upward movement of the actuator as the bottle is inserted.

The second latch member may comprise a plate or other elongate formation secured at an upper end to the carriage by means of a spring arranged so that the lower end of the second latch member may move radially outwardly against the restoring force of the spring. An aperture in a lower part of the plate is arranged to receive a pin or other projection extending from the guide member. When the pin is engaged in the aperture the guide member and carriage are locked together.

The second latch member includes a flange, providing a downwardly facing and outwardly inclined surface. This surface of the flange may engage the upper leading edge of the first latch member, causing the second latch member to pass along the outer surface of the first latch member urging the second latch member radially outwardly. The pin is caused to disengage from the aperture releasing the carriage for movement independently of the guide member.

In particularly preferred embodiments the upper leading edge of the first latch member includes a rebate or cut away portion dimensioned to receive the end of the pin. When the head of the pin is received in the rebate of the first latch member, the aperture of the second latch member cannot engage the pin. The handle may then be freely moved up and down to rotate the spiral as it is raised and lowered. In this way a cork may be penetrated or released from the spiral.

The first latch member may serve as a switch moveable between locked and armed conditions. In the locked condition the spiral rotates as it is raised the lowered. In the armed condition the spiral does not rotate as it is raised and lowered.

A preferred embodiment of the invention includes gripping means adapted to move inwardly when grasped by a user to engage and prevent movement of the neck of a bottle received in the socket.

The gripping means may comprise a pair of arms pivotally mounted on the body and carrying bottle engaging pads adapted to engage and clamp the corkscrew to the bottle. The gripper means may comprise a plurality of arms on the exterior of the body, the bottle engaging pads extending inwardly through apertures in the body. Each arm may be secured by a pivot through an upper part of the body, being biassed outwardly from the body by a spring. The pads are composed of rubber or other resilient or high friction material.

BRIEF DESCRIPTION OF THE DRAWINGS

The invention is described by means of examples but not in any limitative sense, with reference to the accompanying drawings of which.

DETAILED DESCRIPTION OF THE INVENTION

Figure 1:
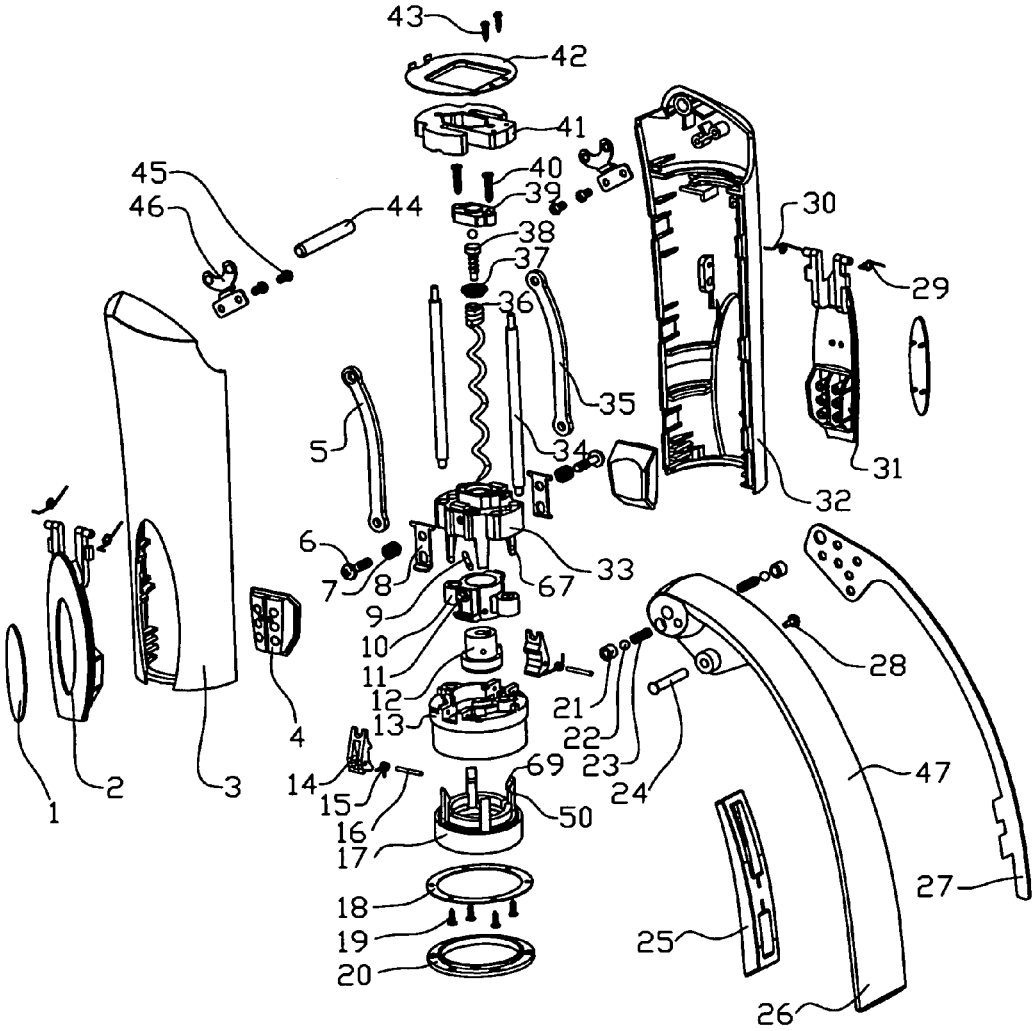
FIG. 1 is an exploded view of a first corkscrew in accordance with this invention.
Figure 2:
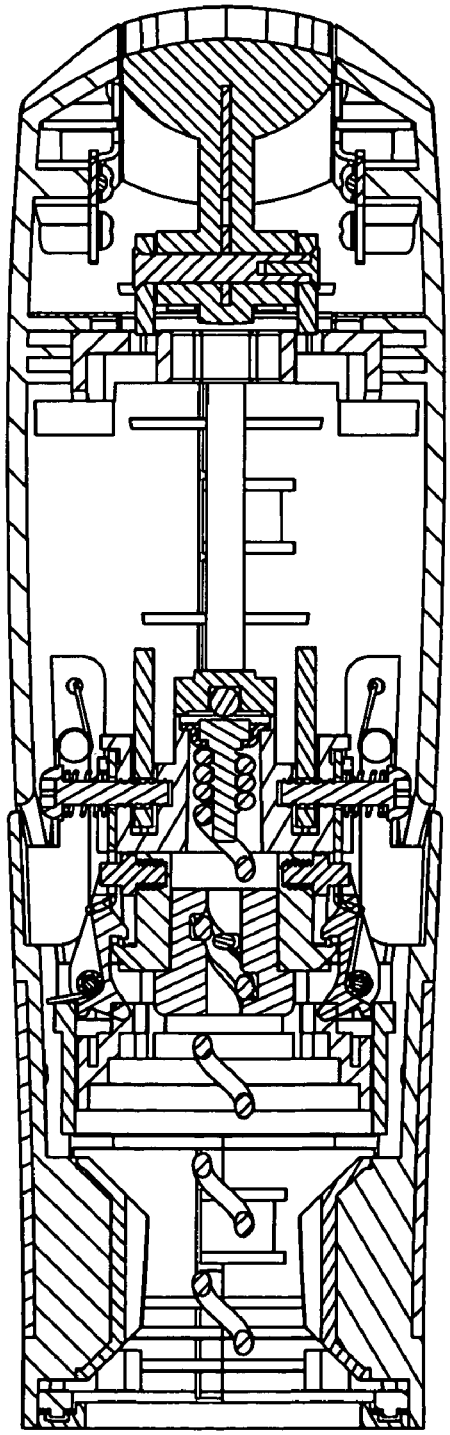
FIG. 2 is a cross-section of the front elevation of the corkscrew.
Figure 3:
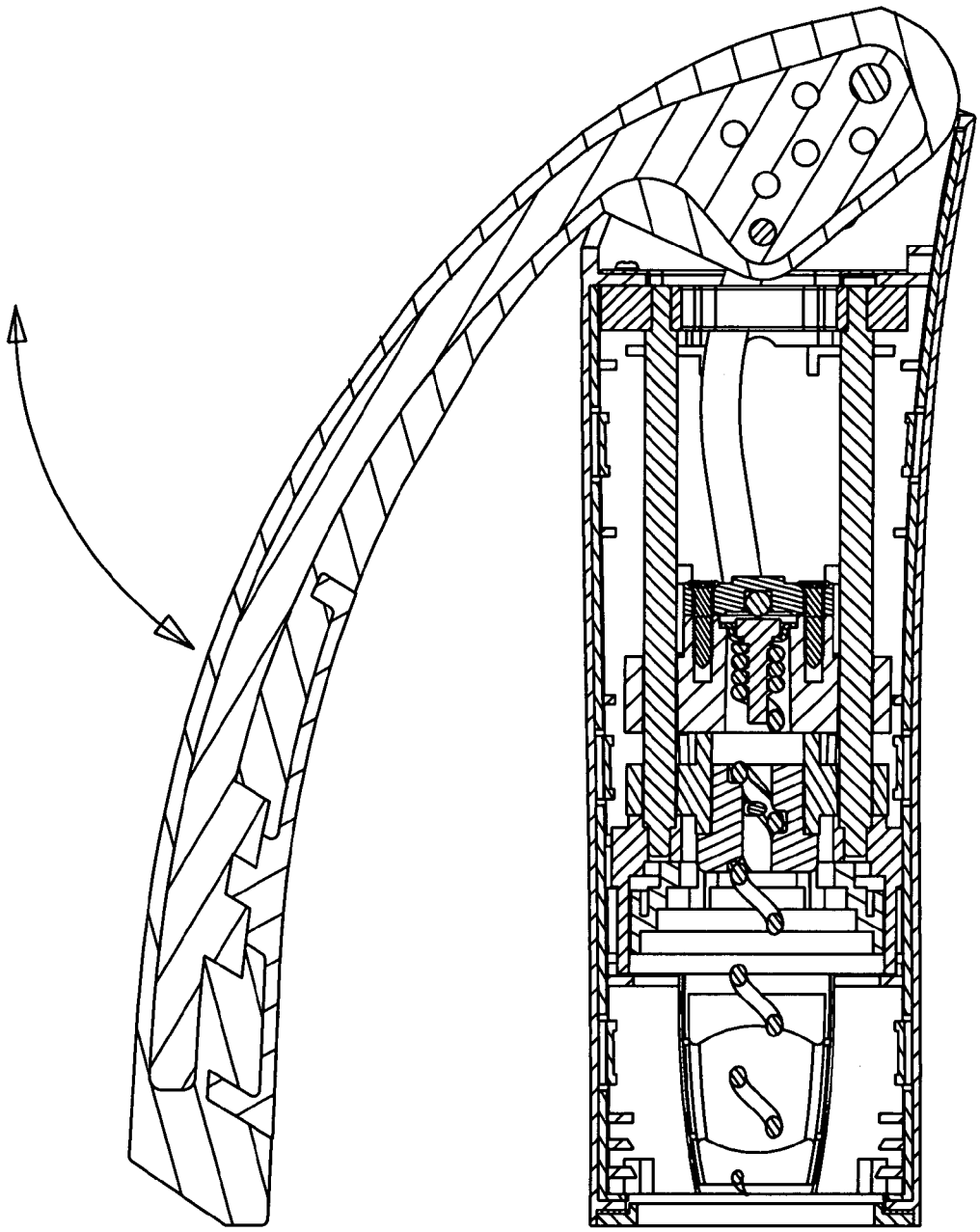
FIGS. 3 to 5 are cross-sectional side elevations of the corkscrew illustrating operation of the moving components.
Figure 4:
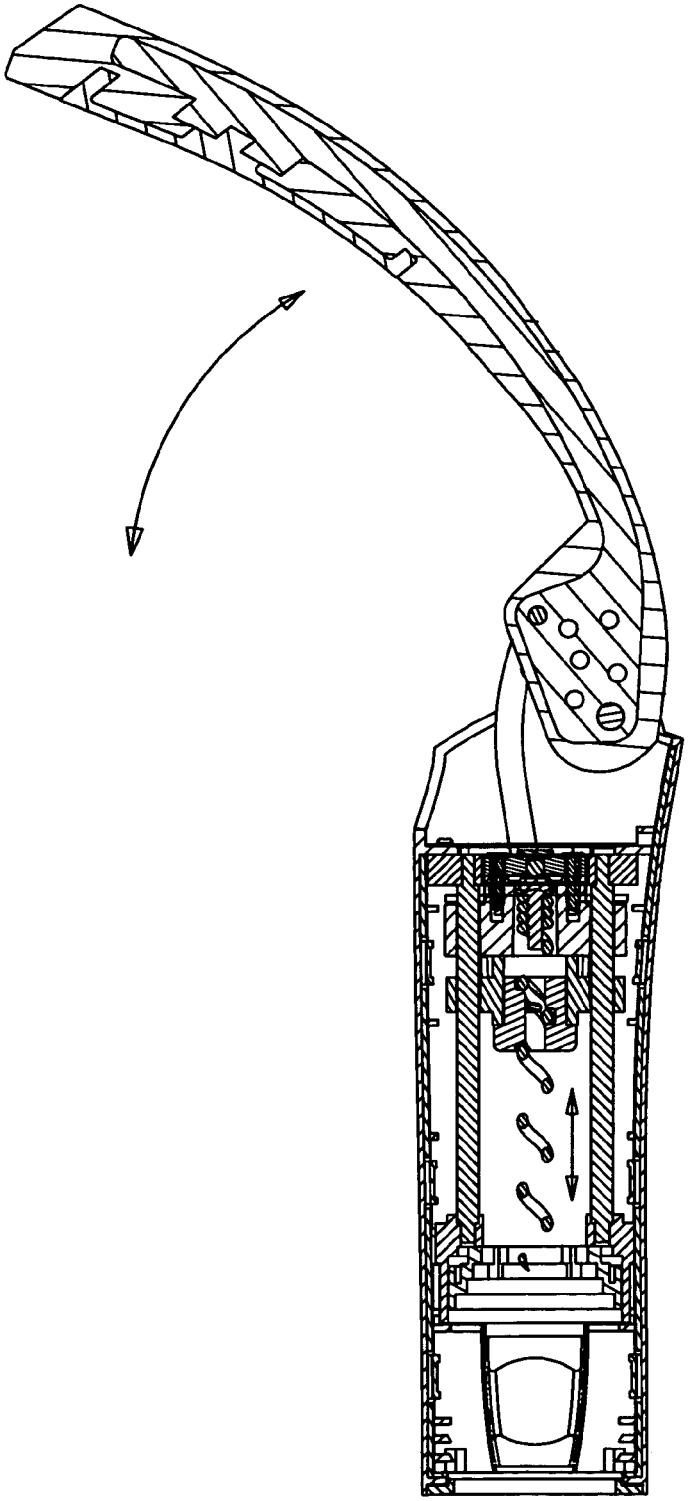
Figure 5:
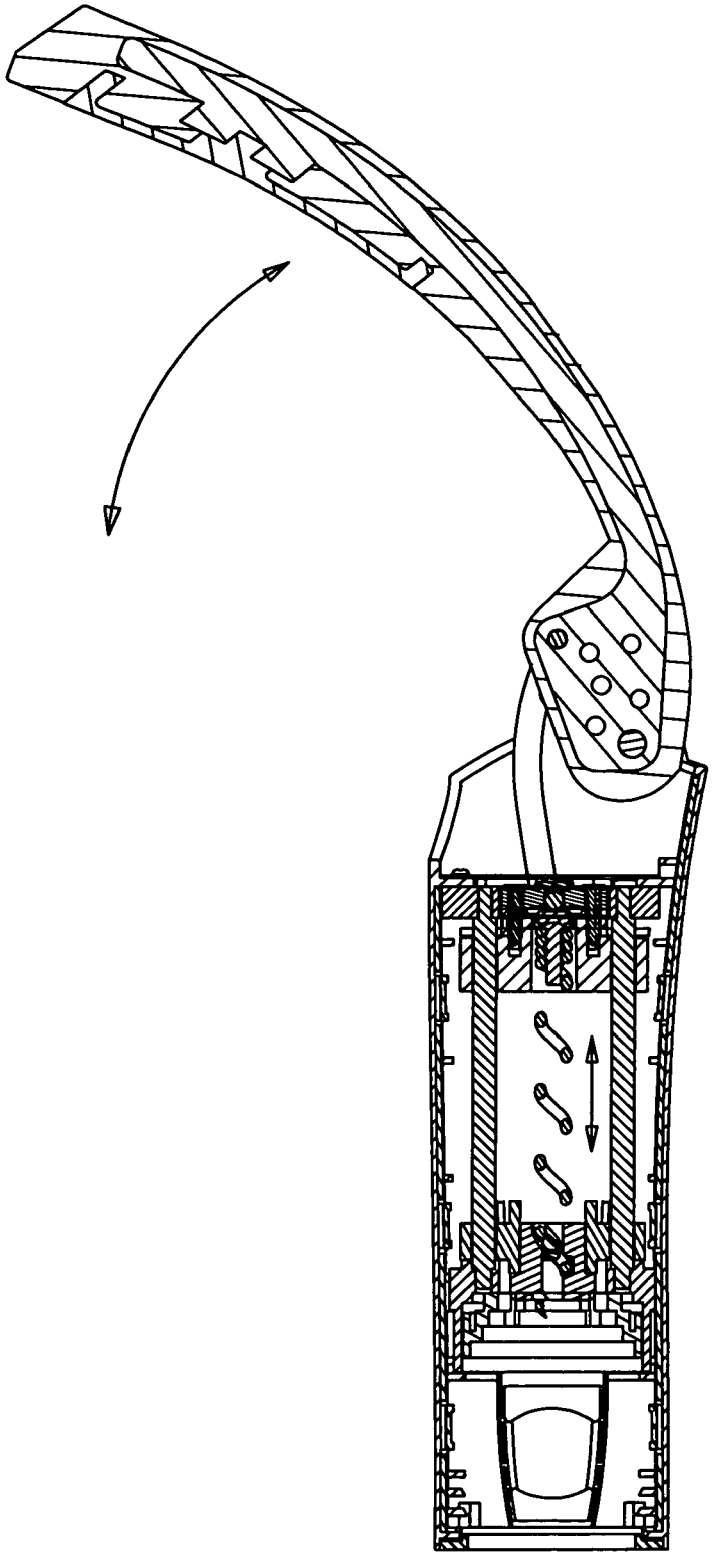
Figure 6:
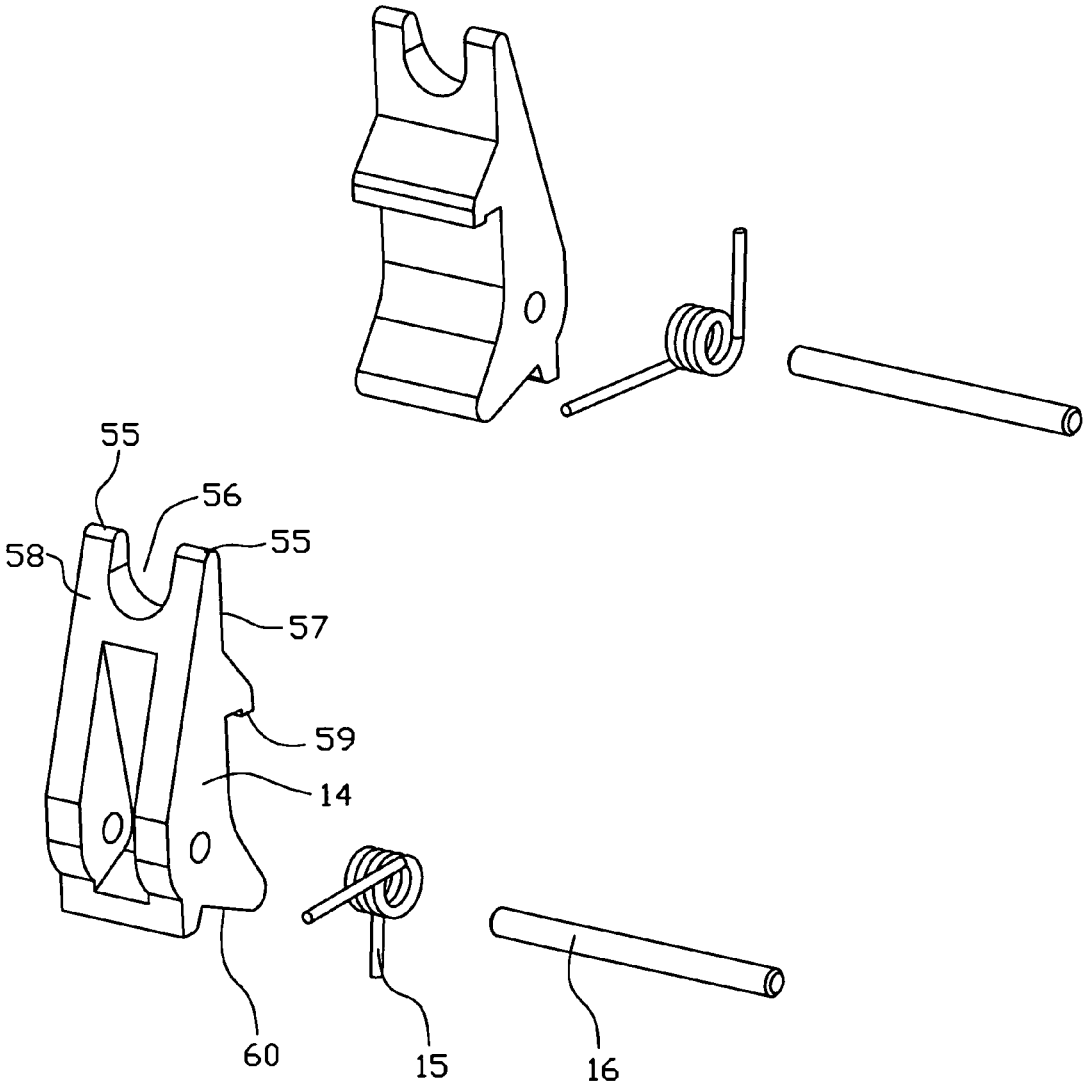
FIG. 6 shows two elevations of the first latch and spring assembly.
Figure 7:
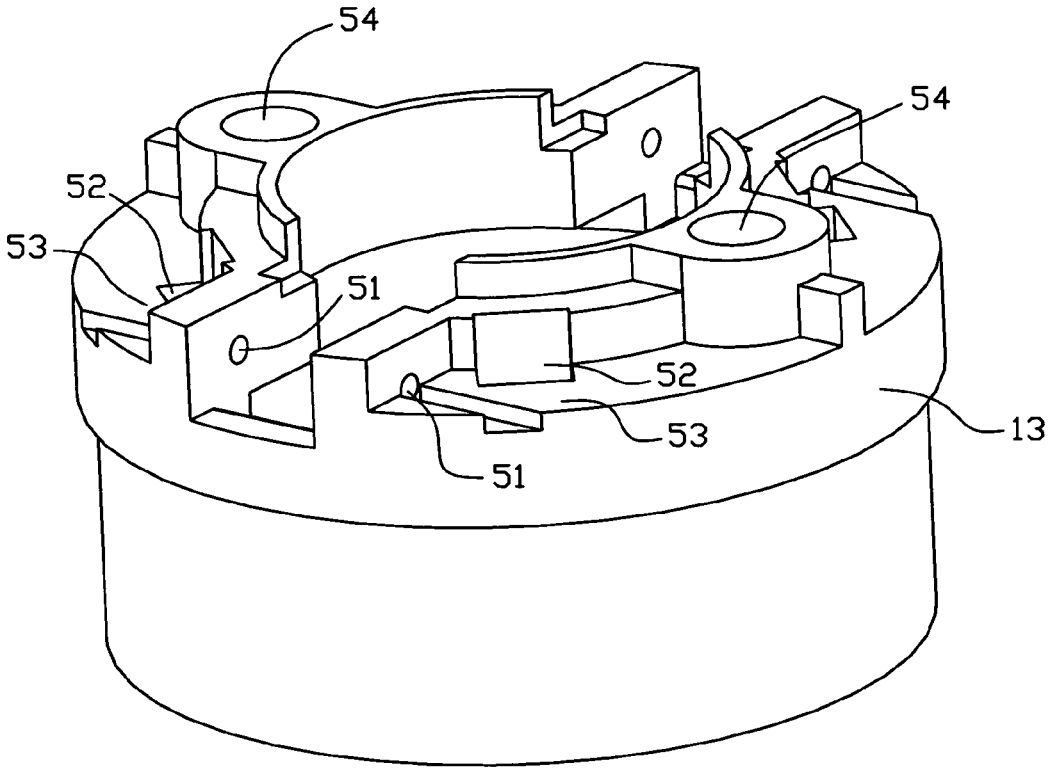
FIG. 7 shows the guideway member.
Figure 8:
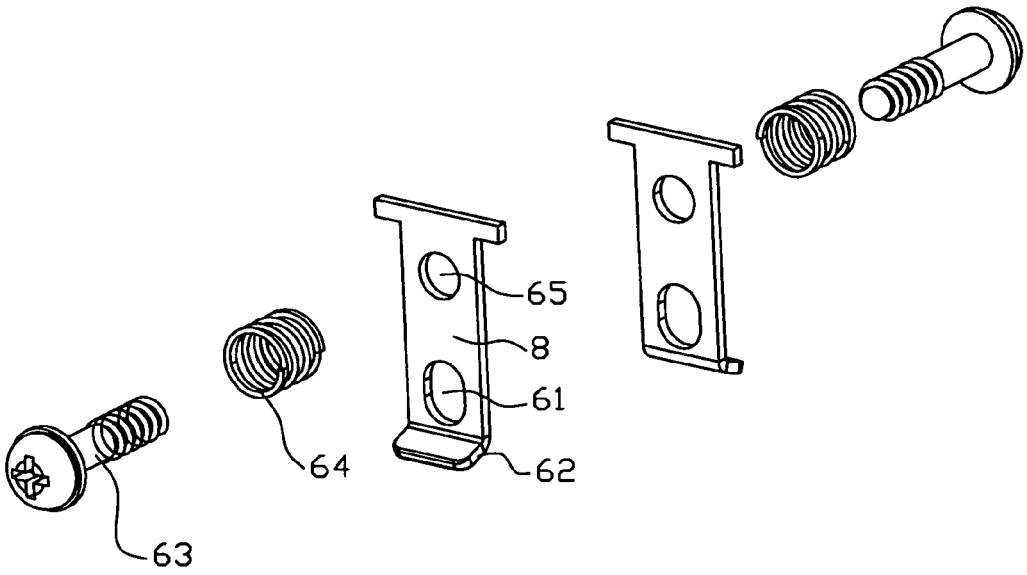
FIG. 8 shows the second latch member.

In the following description the same reference numerals are used to describe the same components in the various drawings of each embodiment.

The corkscrew shown in FIGS. 1–12 comprises a generally cylindrical body having a downward facing opening defining a socket to receive the neck of a bottle. A handle 47 is mounted on a transfer pivot 44 at the top of the body. The body comprises two housing members 3, 32. A pair of bow shaped arms 5, 35 attached to the handle by means of shaft 24 extends downwardly through guide slots in the platform 41.

Handle 47 has a head and a hand grip extending downwardly from the head. The head has bores to receive a bearing shaft 24 a spring 23 and ball bearing 22 to cooperate with a cup 21 in the body to provide a click stop function. The handle also has an aperture to receive a pin 44 for connection to the bow shaped arms 5 and 35. The handle includes gripping pad 25 and an integral reinforcing plate 27.

The lower ends of the arms 5, 35 are pivotally connected by screws 6 to a carriage 33. The carriage 33 is mounted for sliding movement between upper and lower positions along two longitudinal runners 34. The two runners 34 extend from the upper platform 41 and are received in apertures 54 in carriage 13. A sharpened spiral worm screw 38 extends axially downwards from a freely rotatable bearing 39. The screw is coated with a low friction polymer, for example polytetrafluoroethylene to facilitate insertion into the cork and removal in use.

The screw 38 extends through a helical threaded aperture in a guideway sleeve 12 located in the guide member 10. The guide member 10 is slidably mounted on the runners 34. As the carriage 33 moves relative to the guide member, the motion of the screw 38 through the guideway 12 causes the screw to rotate in a clockwise or anti-clockwise direction.

A generally cylindrical guideway member 13 has an axial aperture to permit passage of the worm spiral 38.

A neck engaging member 17 has a downwardly facing opening with concentric stepped annular surfaces to receive bottle necks of different diameters to accommodate necks of different diameters. The member 17 is axially slidable within the guideway 13 between upper and lower positions.

In the embodiment shown in FIGS. 1 to 12 four resilient members 50 having radially inwardly facing leading surfaces 69 and downwardly facing teeth 70 (see FIG. 9) extend upwardly through respective apertures 52 in the member 13. When the neck engaging member 13 is in the uppermost position, the teeth 70 of the resilient members lock against complimentary surfaces 53 of the upper surface of the guideway 13. The resilient members can disengaged by bending them outwardly, by downward pressure on the inclined surfaces 69.

First latch members 14 are mounted for pivotal movement on pin 16 received in bores 51 of the guideway 13. Springs 15 bias the upper parts of the latch members 14 radially inwardly.

The first latch members 14 extend upwardly from the pivot 16. The upper portion of each latch member has inner 57 and outer 58 surfaces which converge at a leading edge 55. A radially inwardly extending protrusion 60 on the lower part of member 14 serves to co-operate with a complimentary surface 71 of the upper moveable guideway portion 33 (FIG. 11) to cause the latch member to rotate against the actual spring 15.

An upper inwardly facing hook shaped projection 59 has a downwardly facing surface to engage a complimentary surface 66 of the guide member.

A U-shaped rebate is cut out of the leading edge 55 to receive the head of the pin 11 of the guide member.

A helical insert 12 in guide member 10 contains a helical aperture to receive in the worm screw 38. The guide member 10 carries a radially outwardly facing pin or stud 11 arranged to be received in aperture 61 in the second latch member 8. The latch member 8 comprises an elongate plate having an outwardly downwardly extending lower flange 62. A screw 62 and spring 64 pass through a bore 65 in the upper part of each plate 8 to secure the second latch to the carriage 33 permitting outward movement of the lower portion of the latch against the action of the spring.

The carriage 33 has four downwardly extending members 67 having feet 68 which engage the inclined surfaces 69 of the resilient members 50 when the latter are in their upper most position and when the carriage moves downwardly, to release the neck engaging portion 17 from the guideway.

FIG. 12(*a*) shows successive steps in the use of a corkscrew in accordance with this invention.

In FIG. 12 the handle of the corkscrew is lowered so that the carriage and guideway are in their lower position. The first latch member is biassed radially inwardly so that the guide member is locked in the lower position. The upper part of the first latch member comprises a tongue having two outer tines and a U-shaped rebate between the tines to receive the pin 11 and the second latch member passes over the outer cam surface of the first latch member without engaging the head of the pin 11. Raising of the handle as shown in FIG. 12(*b*) causes the carriage 33 to be raised with the guideway 10 retained in the lower position. The relative movement of the spiral relative to the guide member causes the spiral to rotate as it is raised.

The corkscrew may then be placed over the neck of a bottle as shown in FIG. 12(*c*). The neck of the bottle engages the actuator or neck engaging portion moving the latter upwardly opening the first latch member as shown by the small arrow in FIG. 12(*c*). The handle is then lowered driving the worm spiral inwards with rotation into the cork as shown in FIG. 12(*d*). In this position the second latch member passes inside the first latch member and engages the pin of the guideway. The downwardly extending feet of the carriage disengage the corresponding feet 69 of the actuator legs 50, pushing the latter downwardly.

Raising of the handle as shown in FIG. 12(*e*) withdraws the cork from the bottle into the body of the corkscrew. The bottle is then removed as shown in FIG. 12(*f*). Subsequent lowering of the handle moves the cork to a lower position as shown in FIG. 12(*g*).

Subsequent raising and lowering of the handle as shown in FIGS. 12(*h* to *j*) allows the first latch member to move inwardly under the action of its spring so that the second latch member passes on the outside of the cam surface. The mechanical arrangement is the same as at the start of the cycle and the subsequent raising of the handle as shown in FIG. 120) releases the cork from the spiral, completing the process.

Operation of the corkscrew is simple and does not require any dexterity. Firstly the lever is raised and the corkscrew is placed over the neck of a bottle and pressed downwardly. The neck of bottle is gripped with the gripper members. Lowering of the lever causes the spiral to move downwardly with rotation to penetrate the cork. The lever is then raised to withdraw the cork and the corkscrew may be removed from the bottle. The lever is then lowered to reset the latch by disengaging the guideway from the carriage. The lever is then raised to release the cork and lowered finally to the rest position.

Figure 9:
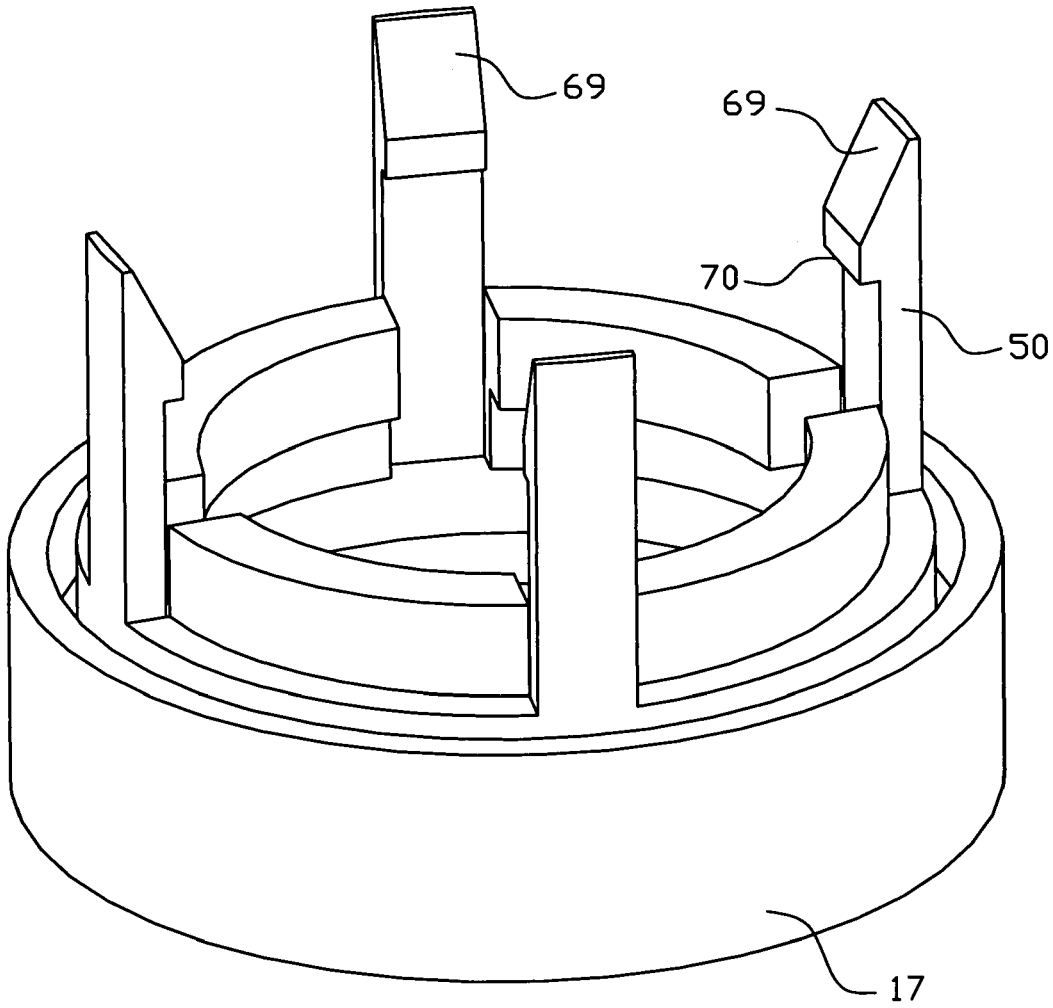
FIG. 9 shows the neck engaging portion.
Figure 10:
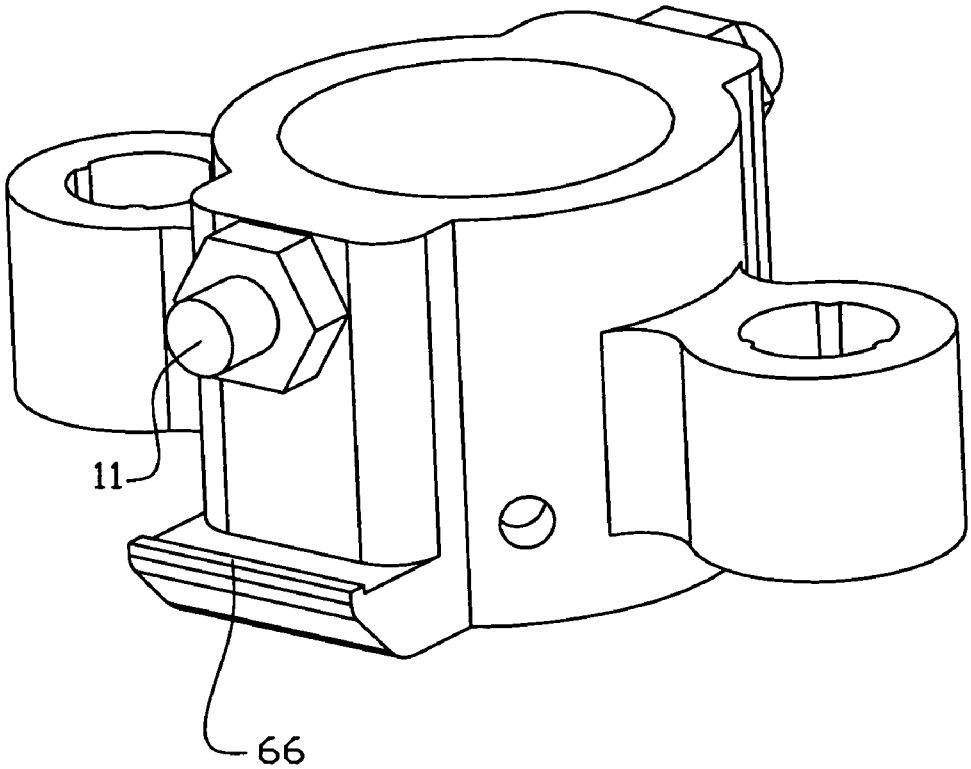
FIG. 10 shows the guide member.

FIGS. 13 to 16 illustrate a second embodiment of the invention similar to the corkscrew shown in FIGS. 1 to 12 but in which the neck engaging portion (100) is modified by removal of the resilient members (50, in FIGS. 1 and 9). In a further alternative embodiment (not shown) the resilient members are modified by removal of the teeth (70, in FIG. 9). The height of the lower part of the resilient members (101) may be limited to be flush with the surface (102) of the main body of the neck engaging portion.

Removal of the teeth or complete removal of the resilient members prevents locking of the neck engaging portion (100) to the guide member (103). When the engaging member (100) is pushed upwardly by insertion of the neck of a bottle, the first latch means (104) is pushed upwardly and rotated outwardly in the same way as in the first embodiment. However, the engaging member (100) moves back to a lower position after the bottle neck is removed. Thus the engaging member (100) automatically returns to the lower position where the cork has been removed and the bottle withdrawn as shown in FIG. 12(*f*) for the first embodiment. In the second embodiment stages 12(*g*) and 12(*h*) are omitted so that the corkscrew is in the configuration shown in FIG. 12(I). Thus when using the second embodiment a simplified operating procedure is achieved. Construction of the second embodiment is simpler and the corkscrew is therefore more reliable in use.

One of more springs or other resilient members (not shown) may be provided between the downward facing surface of the guide member (103) and the upward facing surface of the engaging member (100). The spring or springs facilitate separation of these components to ensure that the engaging member returns to the lower initial position as soon as the bottle neck is removed from the corkscrew body.

Figure 11:
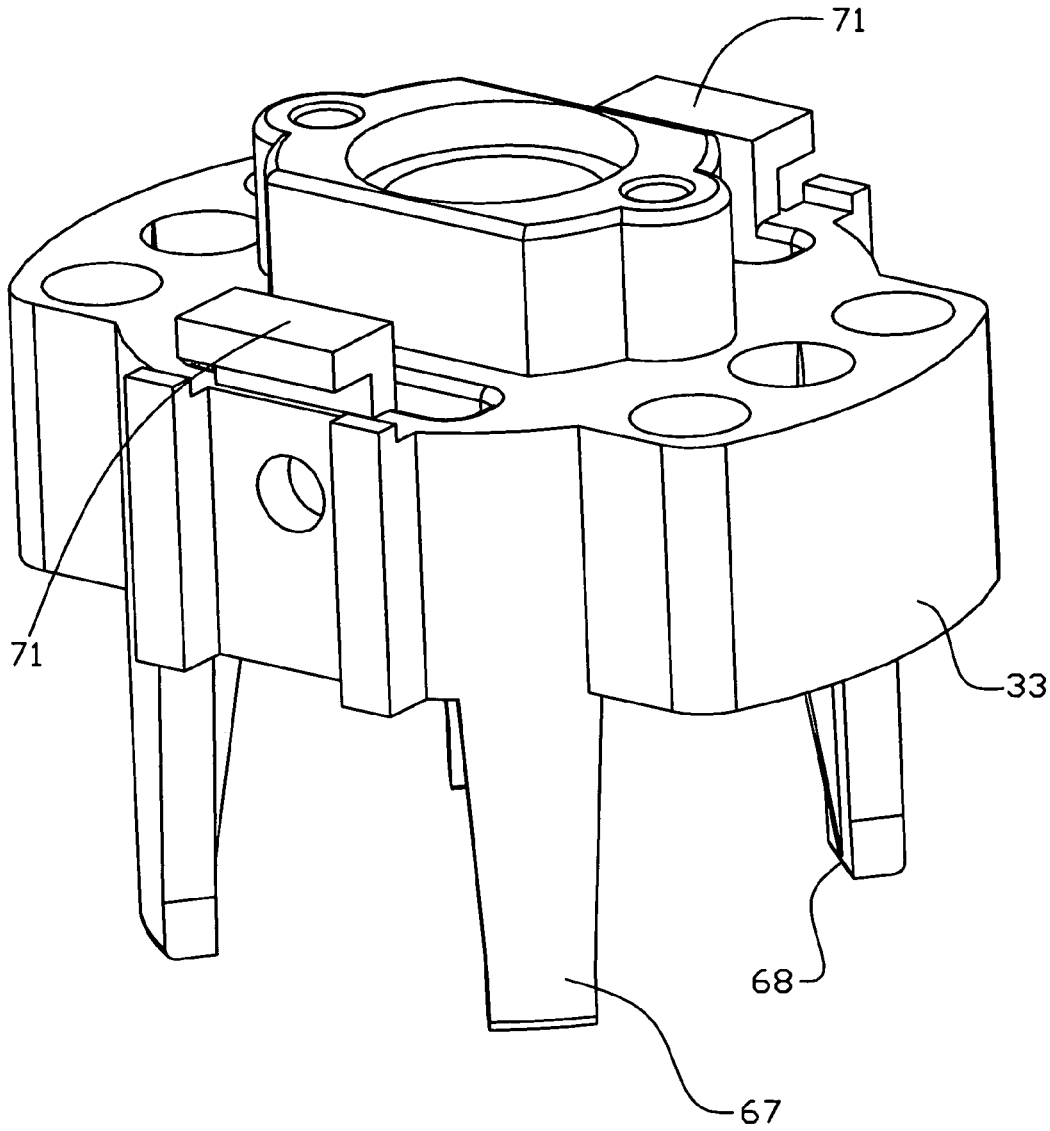
FIG. 11 shows the carriage member.
Figure 12A:
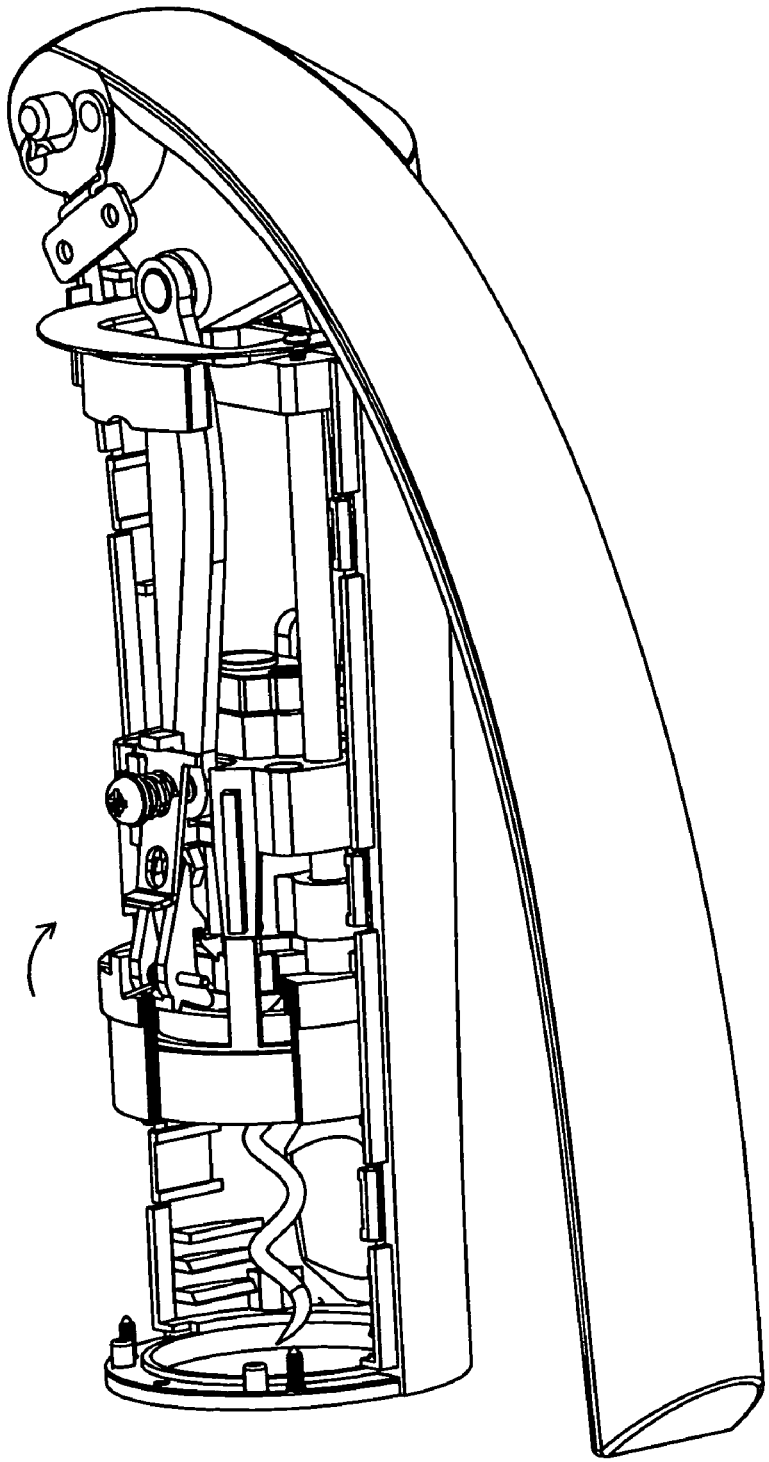
FIG. 12 contains views illustrating the use of the first corkscrew.
Figure 12B:
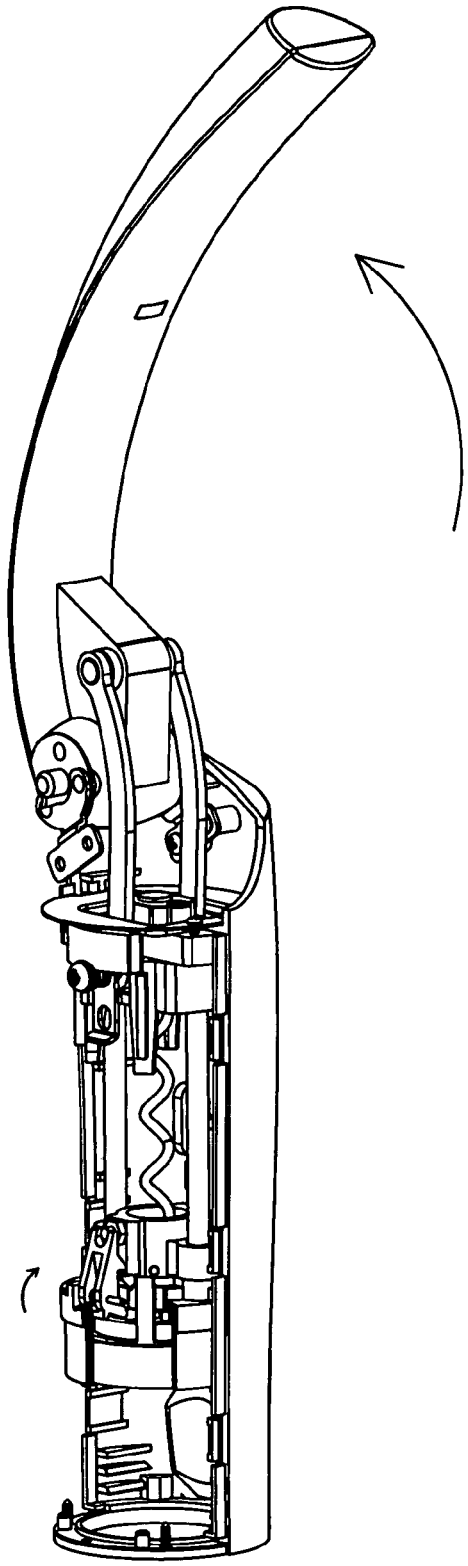
Figure 12C:
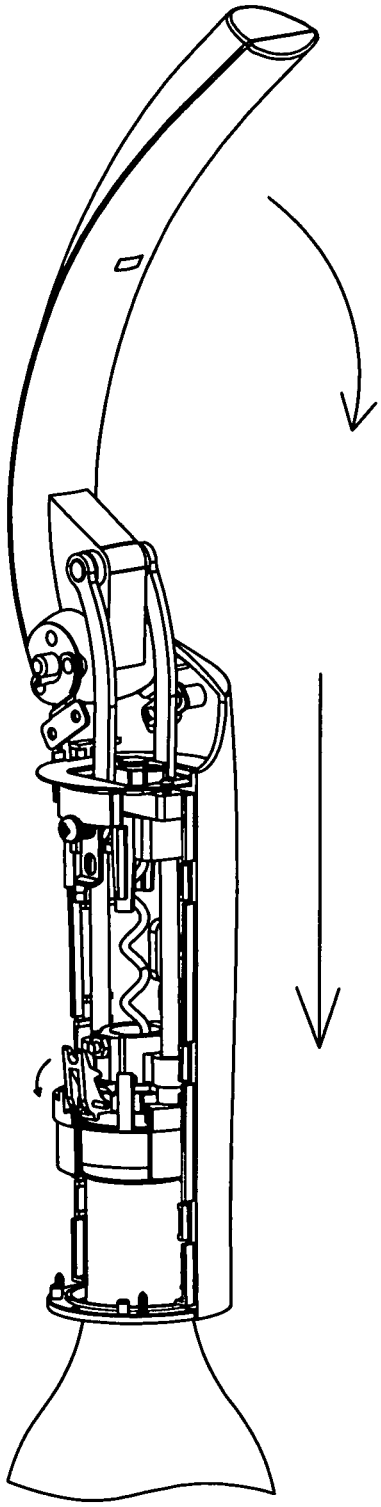
Figure 12D:
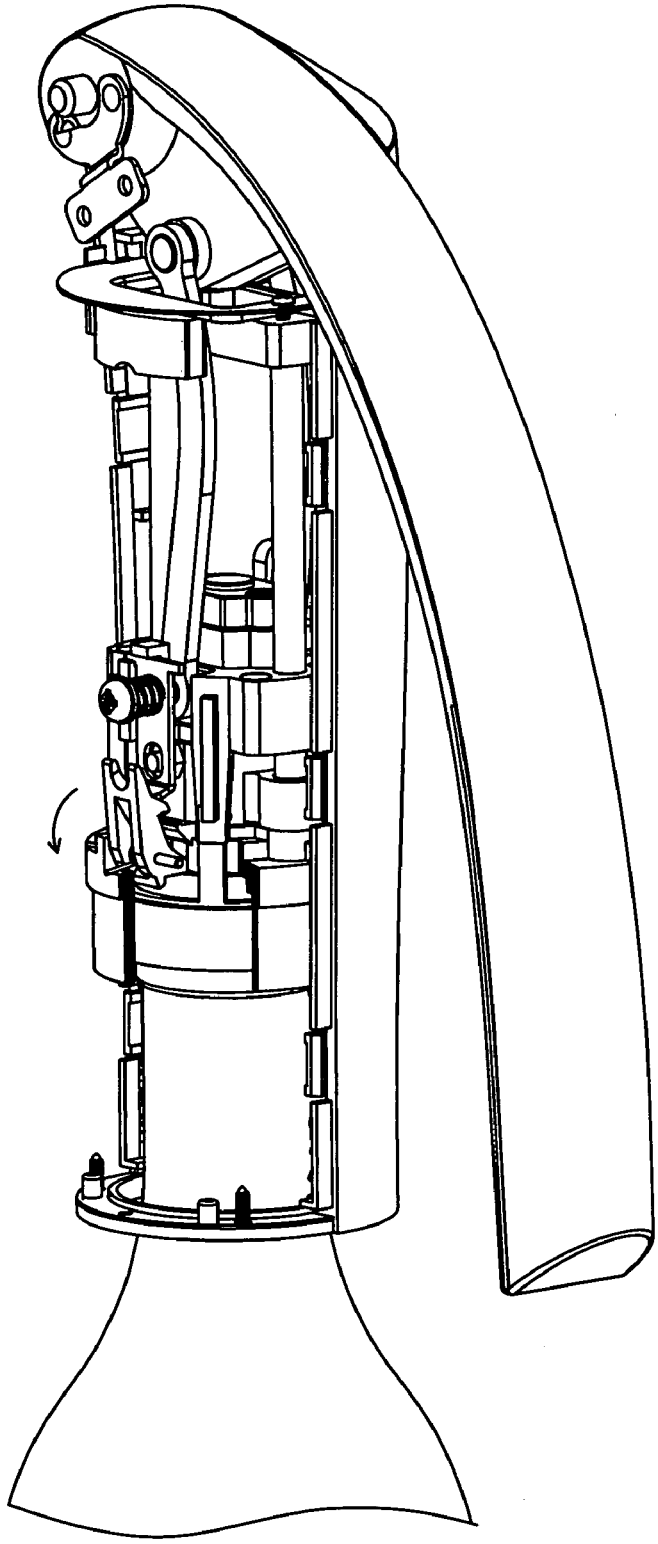
Figure 12E:
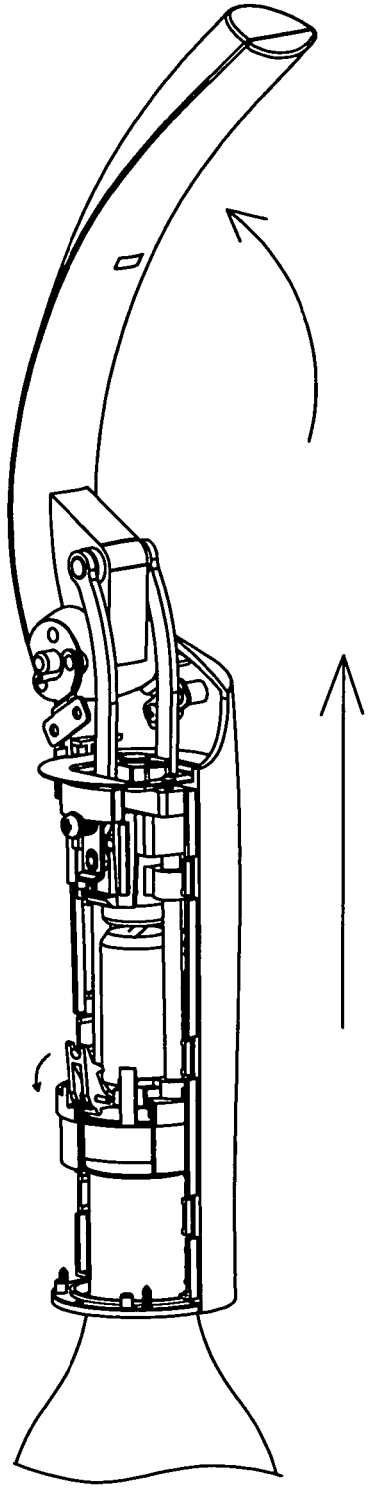
Figure 12F:
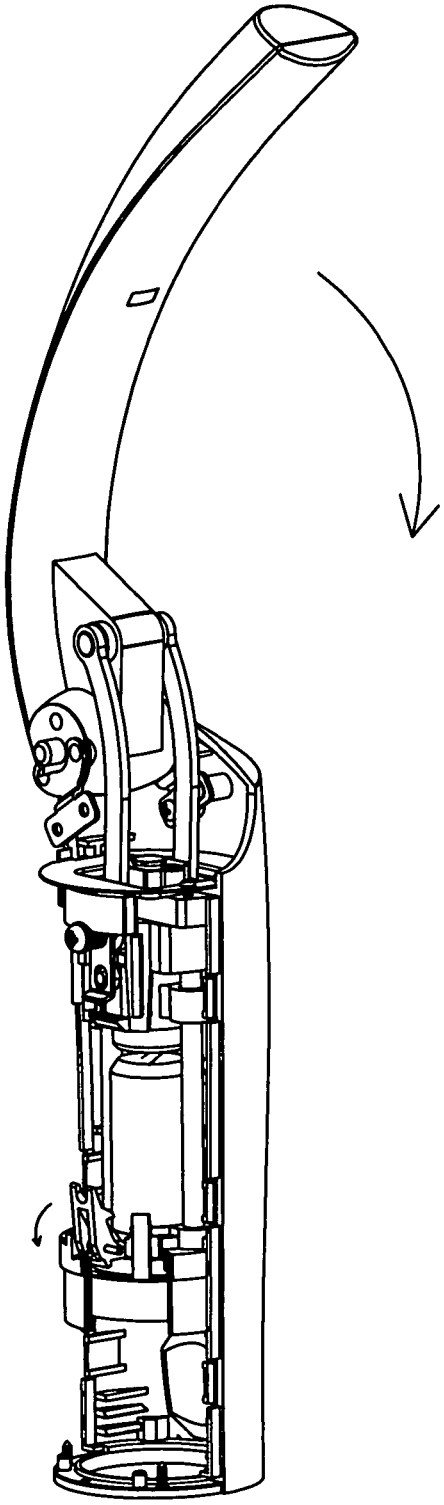
Figure 12G:
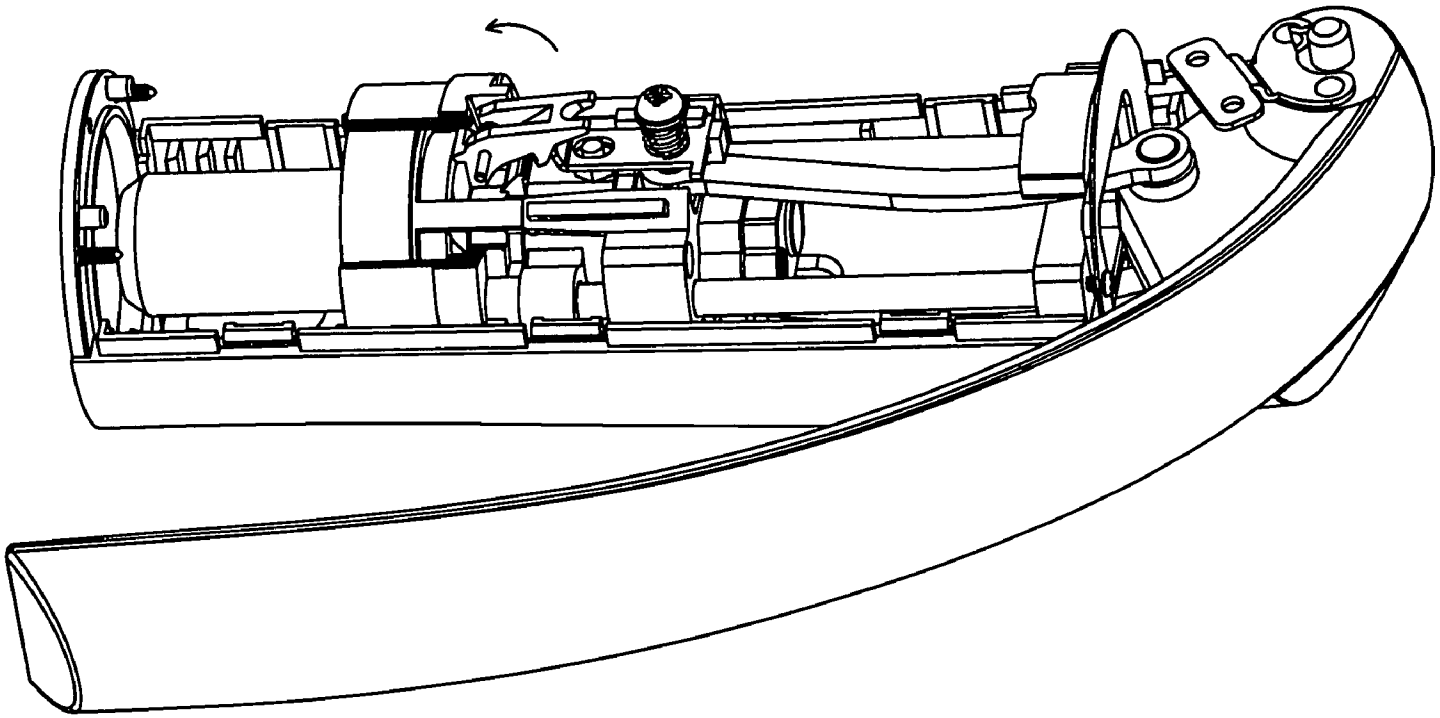
Figure 12H:
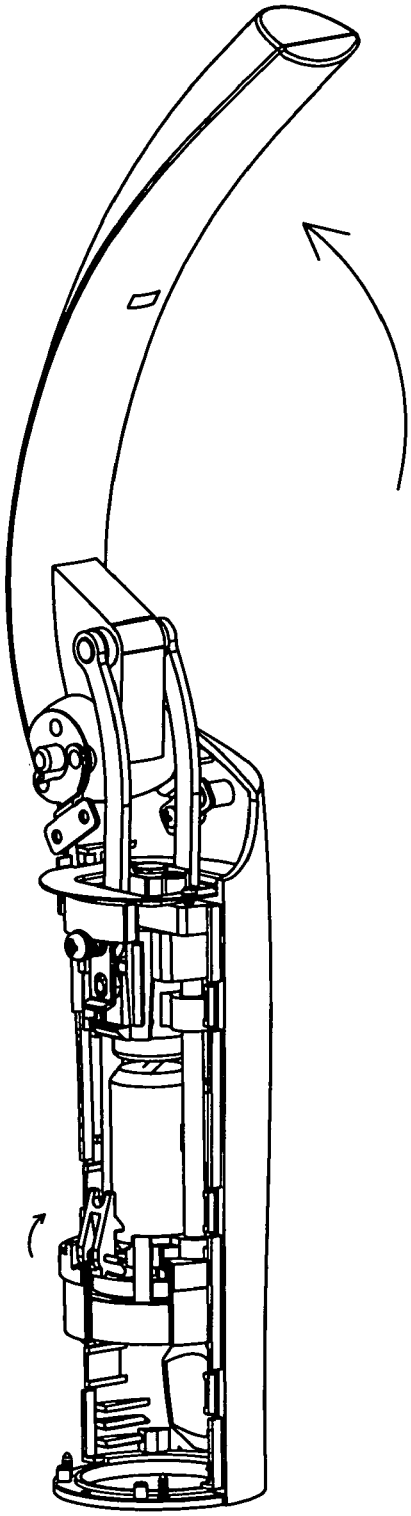
Figure 12I:
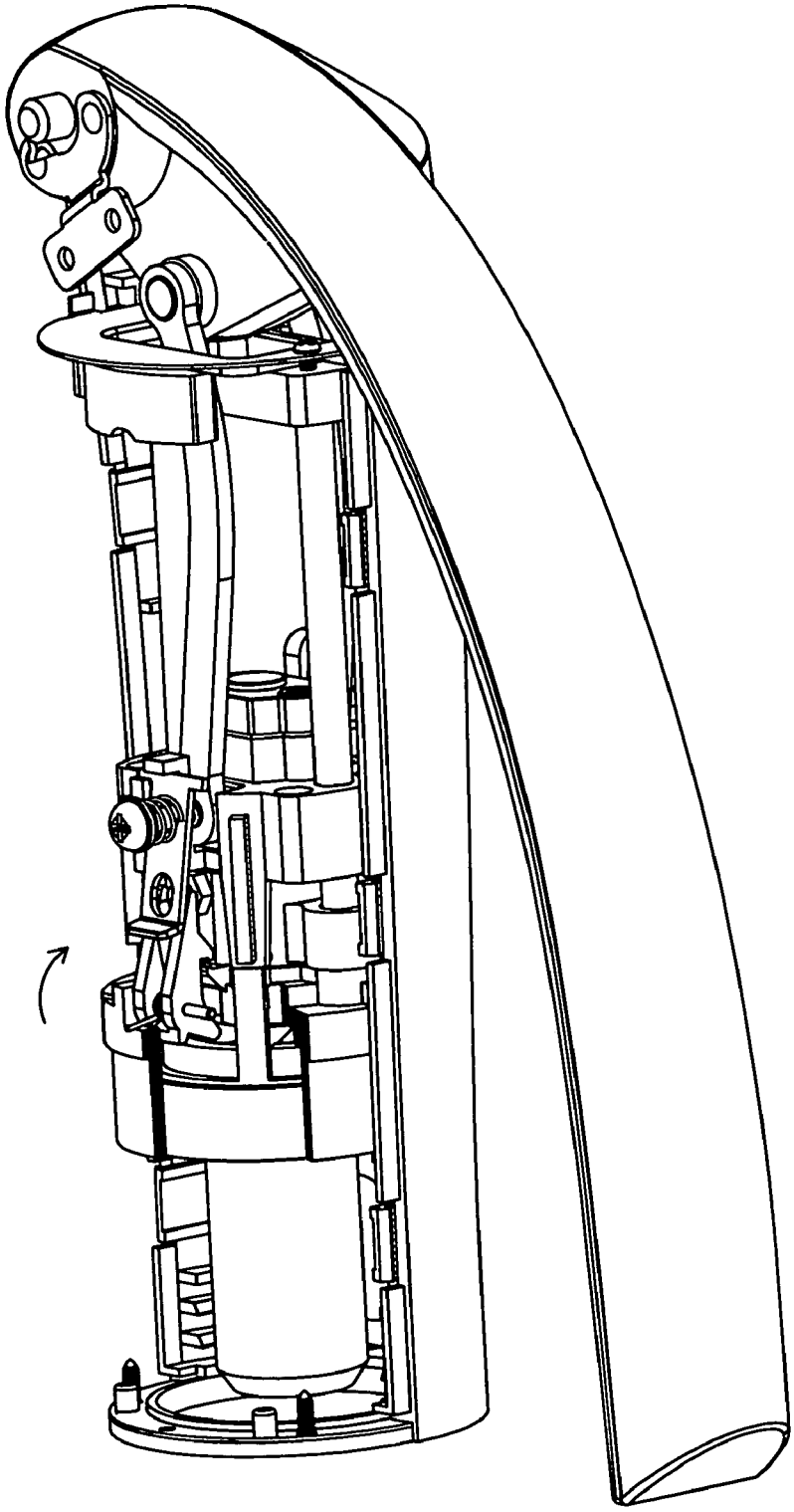
Figure 12J:
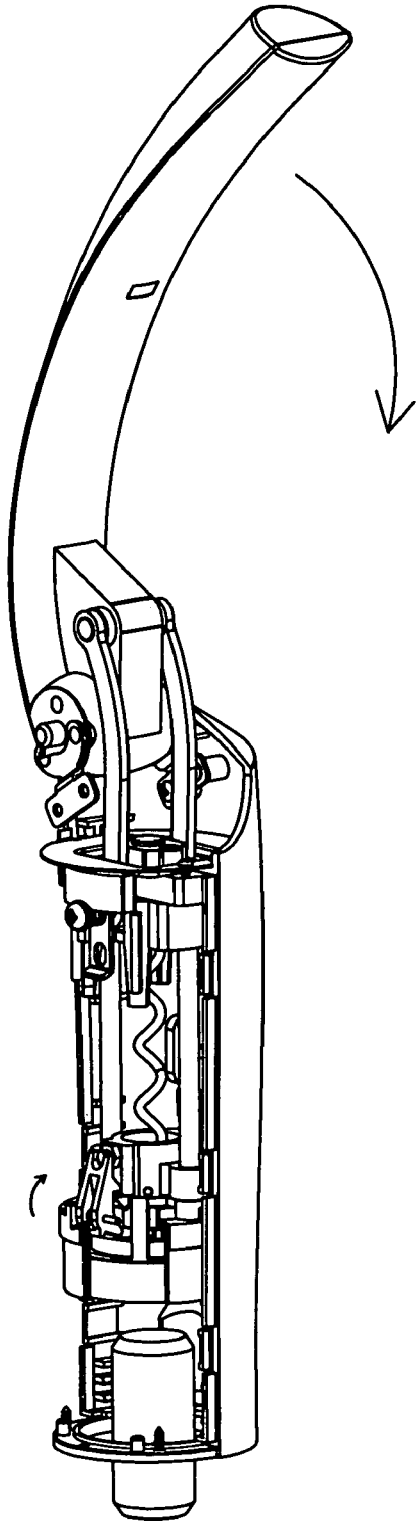
Figure 13:
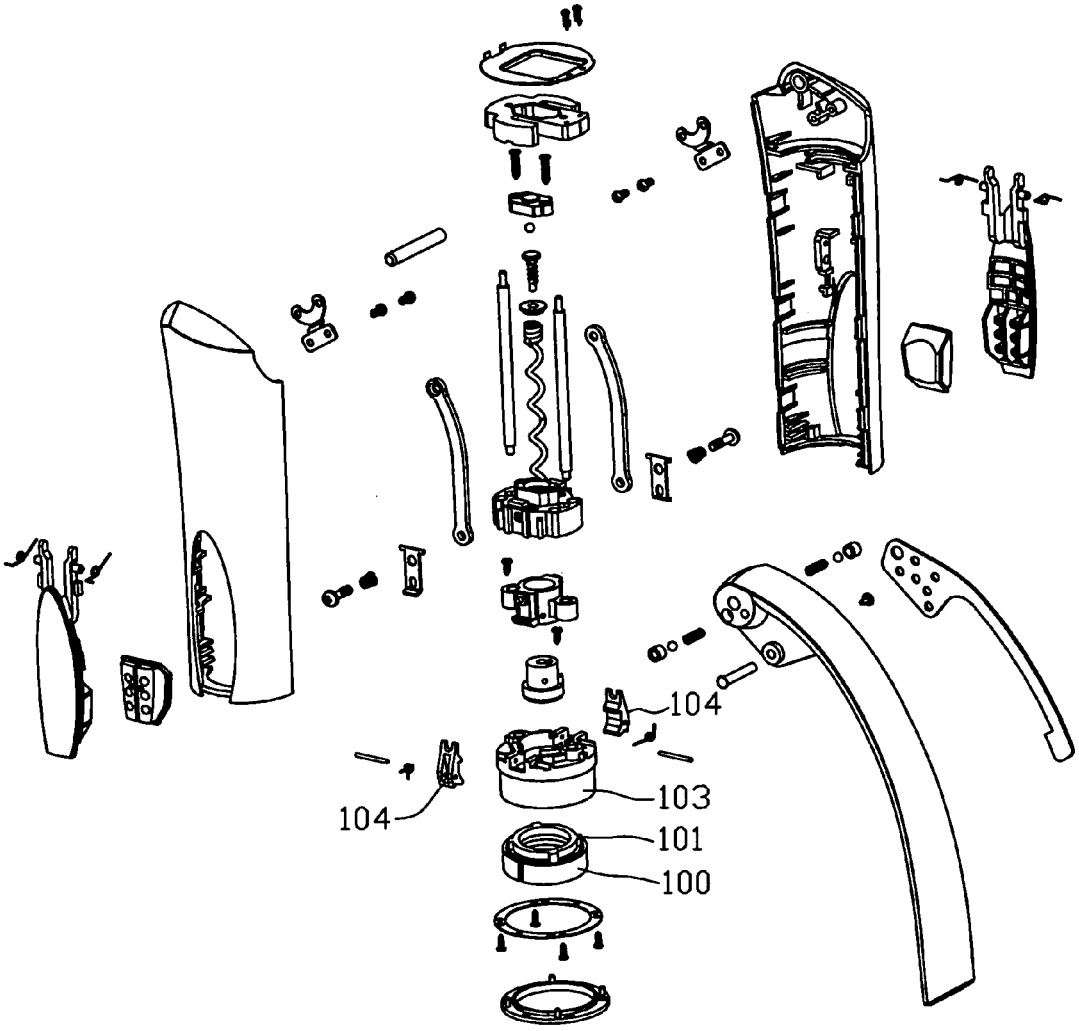
FIG. 13 is an exploded view of a second corkscrew in accordance with this invention.
Figure 14:
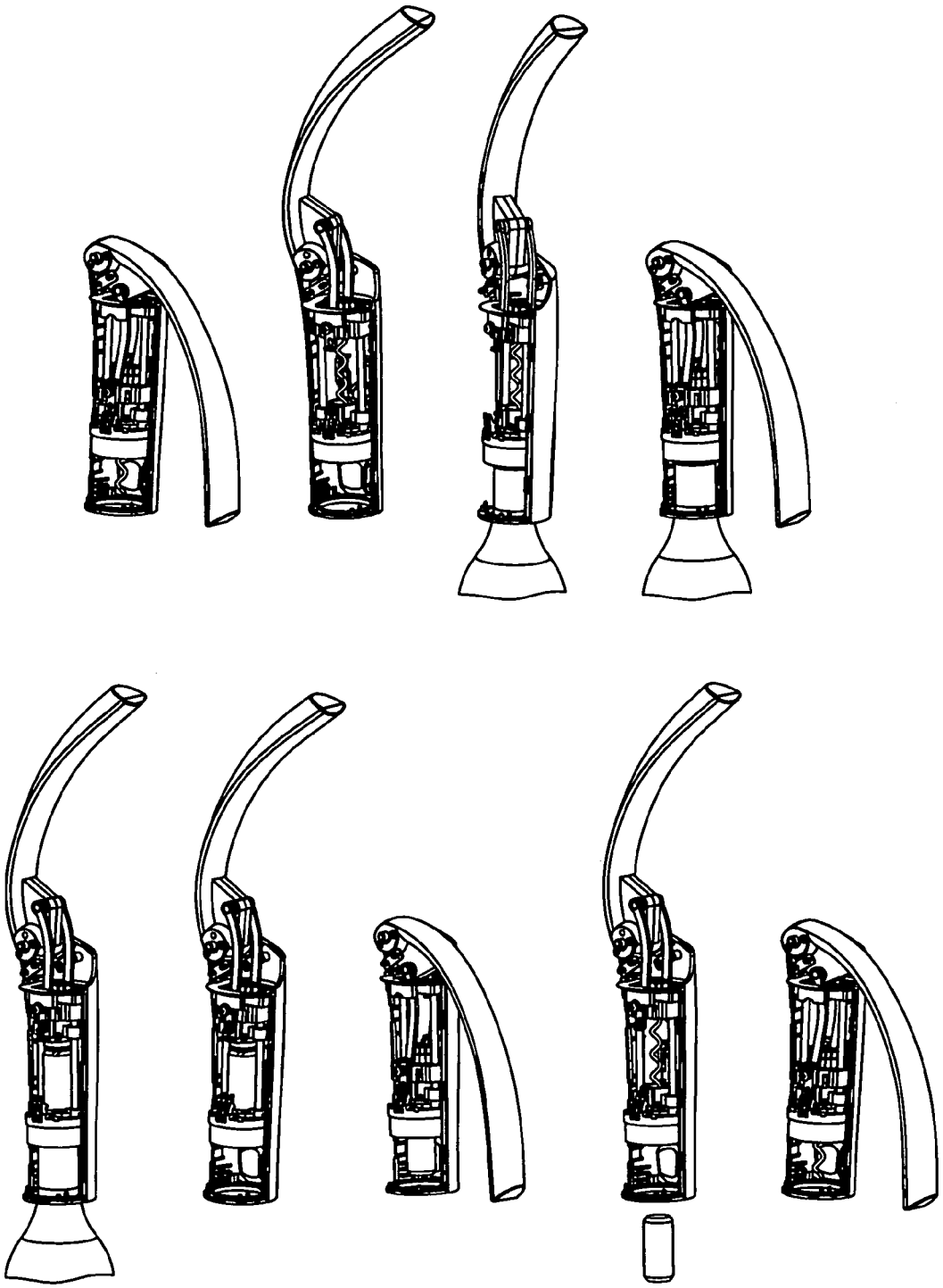
FIG. 14 contains views illustrating use of the corkscrew shown in FIG. 13.
Figure 15:
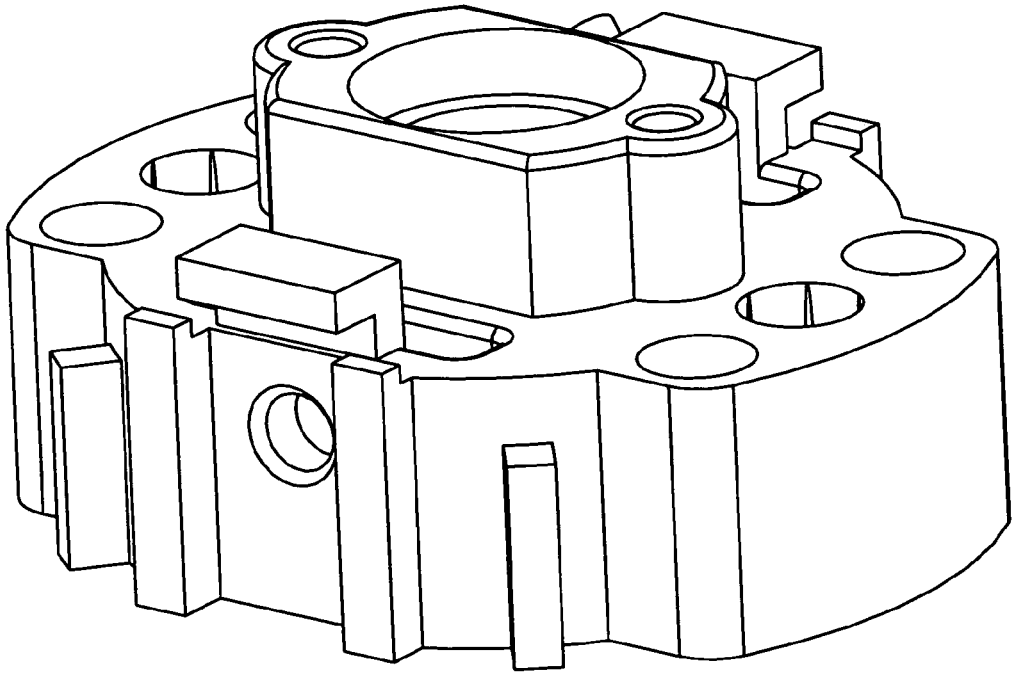
FIG. 15 shows the guideway member of the second corkscrew.
Figure 16:
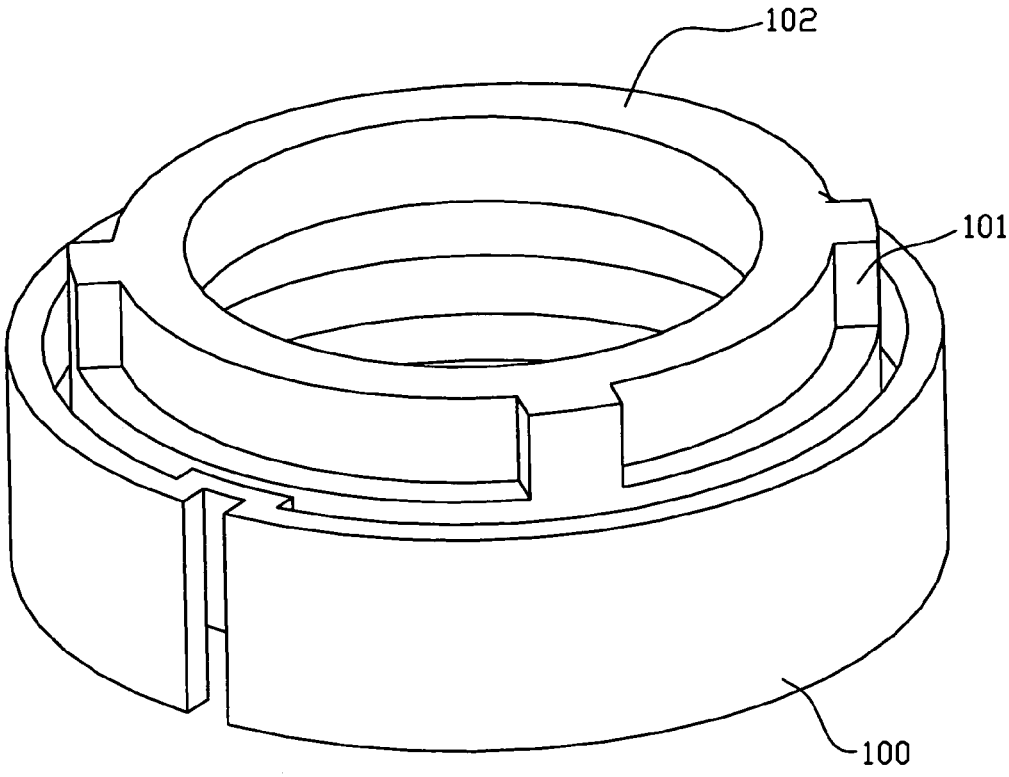
FIG. 16 shows the neck engaging portion of the second corkscrew.

In a preferred embodiment the downwardly extending legs (67) of FIGS. 1 and 11 are removed as shown in FIG. (15).

The corkscrew shown in FIGS. 17–23 comprises a generally cylindrical body having a downward facing opening defining a socket to receive the neck of a bottle. A handle 200 is mounted on a transfer pivot 201 at the top of the body. The body comprises two housing members 202, 203. A pair of bow shaped arms 205, 206 attached to the handle by means of shaft 204 extends downwardly through guide slots in the platform 213, secured by a fixing plate 207.

Handle 200 has a head and a hand grip extending downwardly from the head. The head has bores to receive a bearing shaft 204 springs 208 and ball bearings 209 to co-operate with cups 210 in the body to provide a click stop function. The handle also has a bore to receive a pin 204 for connection to the bow shaped arms 205 and 206. The handle includes a gripping pad (not shown) and an integral reinforcing plate (not shown).

The lower ends of the arms 205, 206 are pivotally connected by screws to a carriage 211. The carriage 211 is mounted for sliding movement between upper and lower positions along two longitudinal runners 212. The two runners 212 extend from the upper platform 213 and are received in apertures 214 in the guideway carriage 211. A sharpened spiral worm screw 215 extends axially downwards from a freely rotatable bearing 216. The screw is coated with a low friction polymer, for example polytetrafluoroethylene to facilitate insertion into the cork and removal in use.

The screw 215 extends through a helical threaded aperture in a guideway sleeve 218 located in the guide member 219. The guide member 219 is located within the sleeve 218 and both compounds are slidably mounted on the runners 212. As the carriage 211 moves relative to the guide member 219, the motion of the spiral screw 219 through the aperture 218 in the guideway 219 causes the screw to rotate in a clockwise or anti-clockwise direction.

The generally cylindrical carriageway 211 has an axial aperture to permit passage of the spiral 215.

A neck engaging member 220 has a downwardly facing opening with concentric stepped annular surfaces to receive bottle necks of different diameters ensuring that the bottle necks are engaged coaxially with the corkscrew. The member 220 is fixed between the body halves 205, 206 to provide a secure socket to receive a bottle neck.

FIGS. 17 to 29 illustrate construction and use of the third embodiment of the invention.

The corkscrew shown in FIGS. 17 to 29 comprises a generally cylindrical body with a downwardly facing opening to define a socket to receive the neck of a bottle.

The two first latch members 221 have bores at lower ends thereof to receive pins 222 to engage in sockets in the respective body halves 202, 203. The upper end of each first latch member similar to that shown in FIG. 6. The upper portion 228 of each first latch member has inner and outer surfaces which converge at a leading edge 227. A U-shaped rebate 226 is cut out from the leading edge 227 is adapted to receive the pin 230 of the guide member. A spring 223 engaged on a lug 224 of the body shell 203 serves to urge the latch member 221 radially inwardly so that the shoulders or cam surfaces 229 engage the neck of a bottle as it is inserted into the socket of the corkscrew body.

The guide member 217 contains radially outwardly facing pins or studs 230 arranged to be received and engaged in apertures 233 in the second latch members 232. Each second latch member 232 comprises an elongate plate having an outwardly and downwardly extending lower flange 234. A screw 235 and spring 236 pass through a bore in the upper part of each plate 232 to secure the second latch to the carriage 211 permitting outward movement of the lower portion of a latch against the action of the spring.

Figure 17:
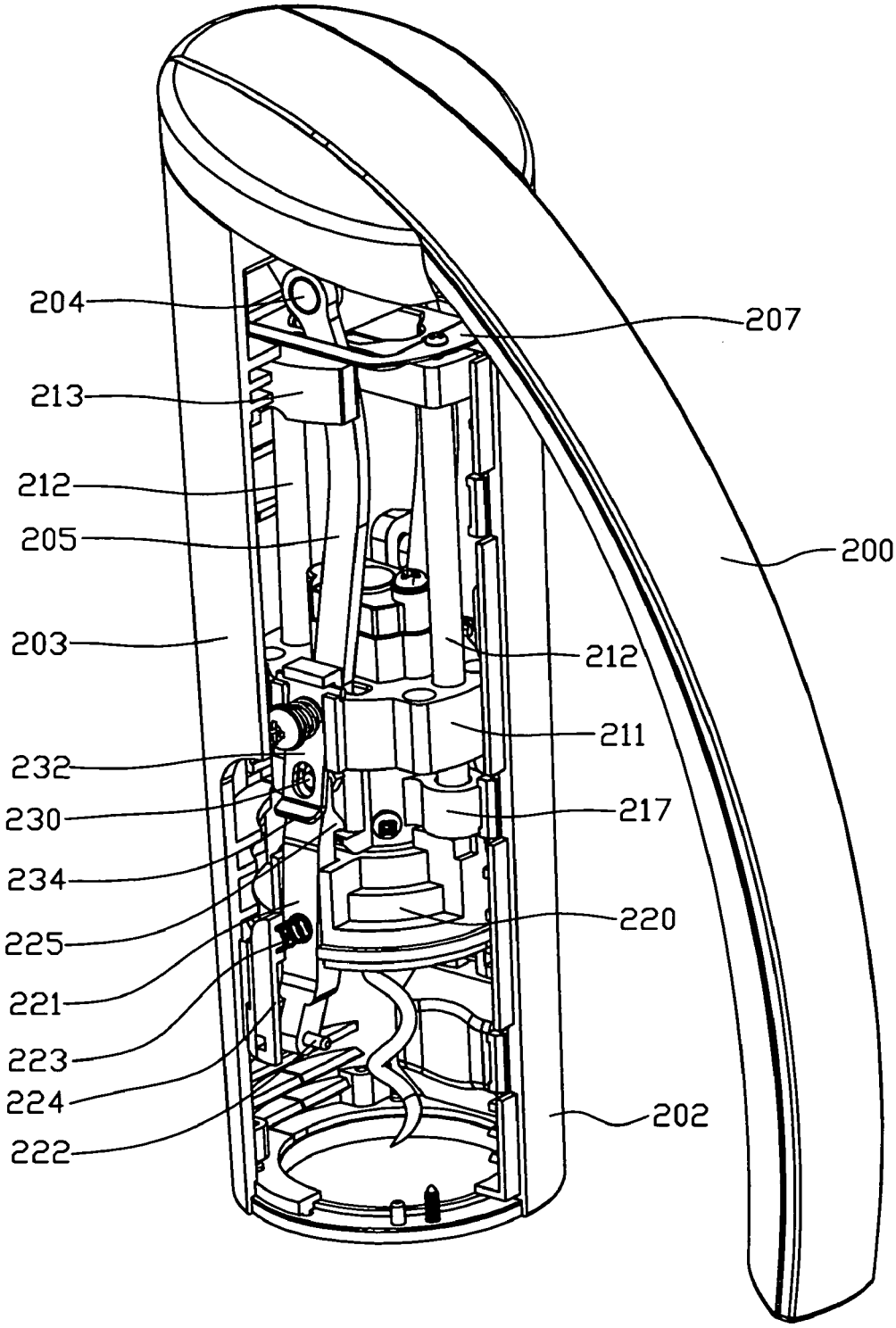
FIGS. 17 to 24 are partially cut away views illustrating the construction and use of a third corkscrew in accordance with this invention.
Figure 18:
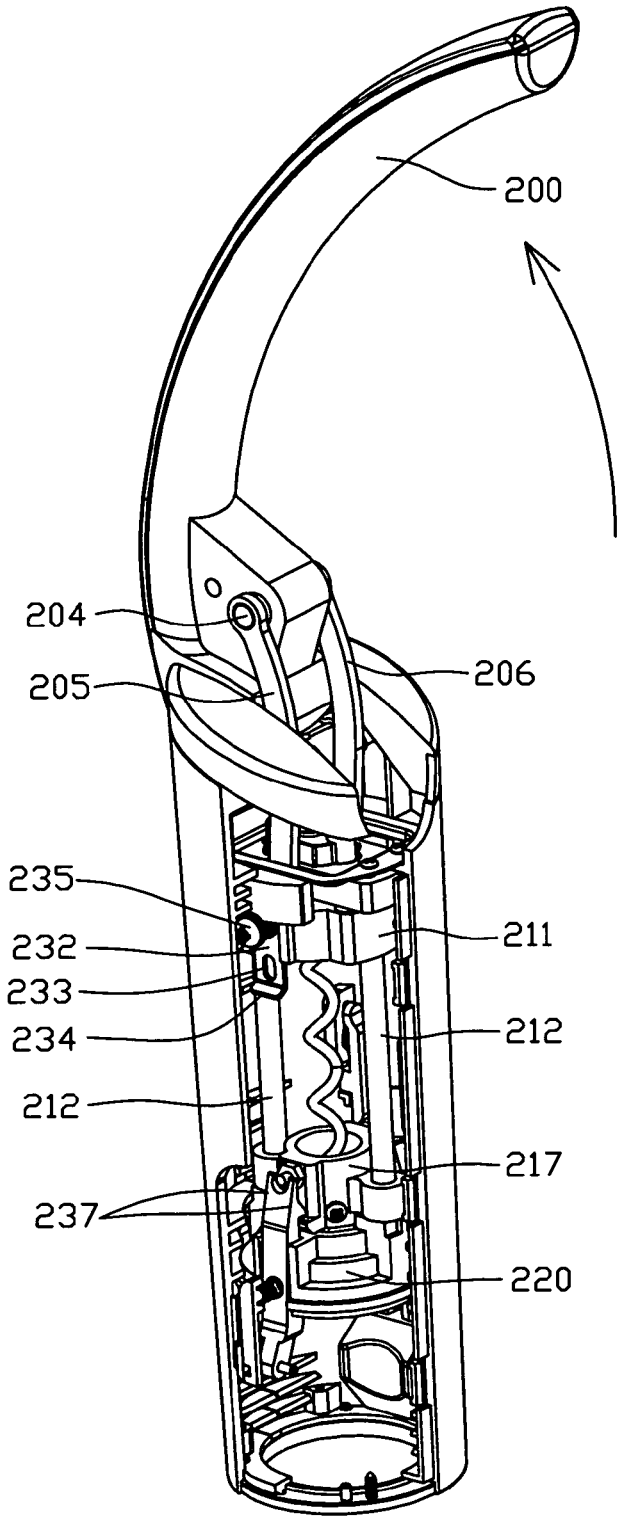
Figure 19:
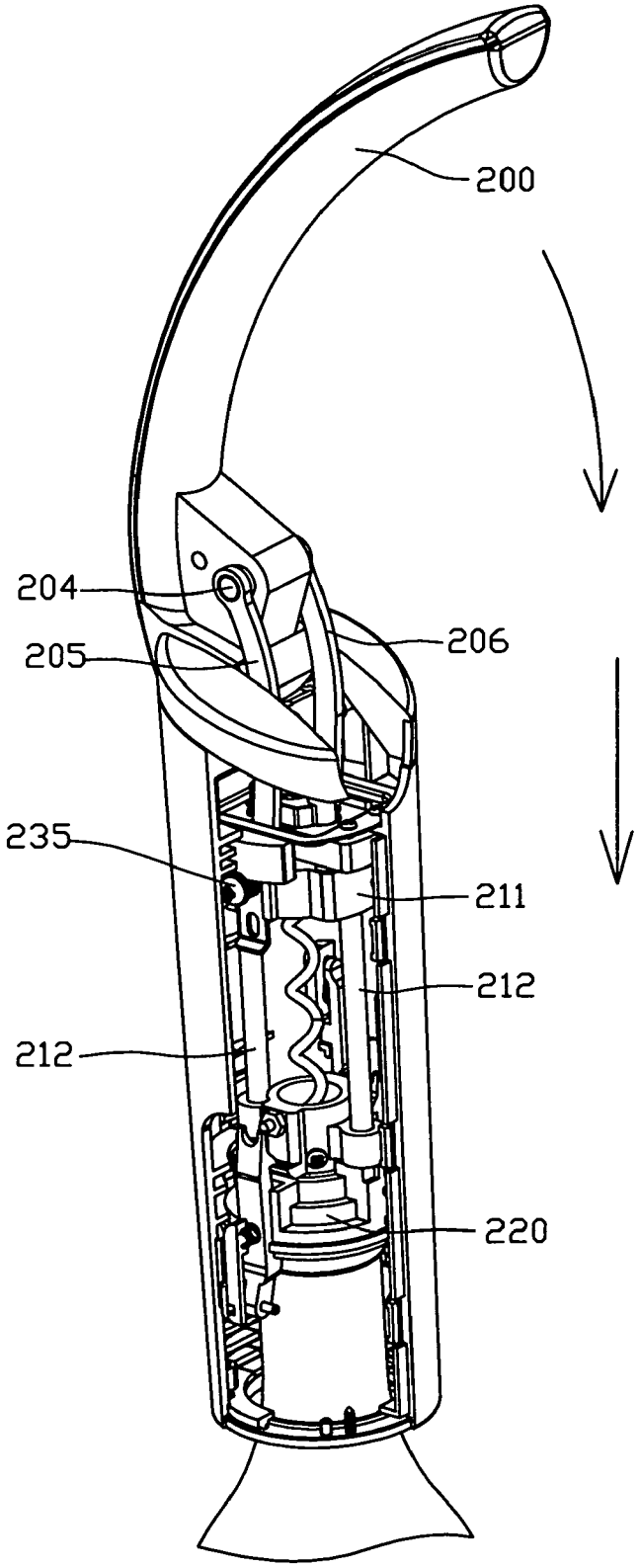
Figure 20:
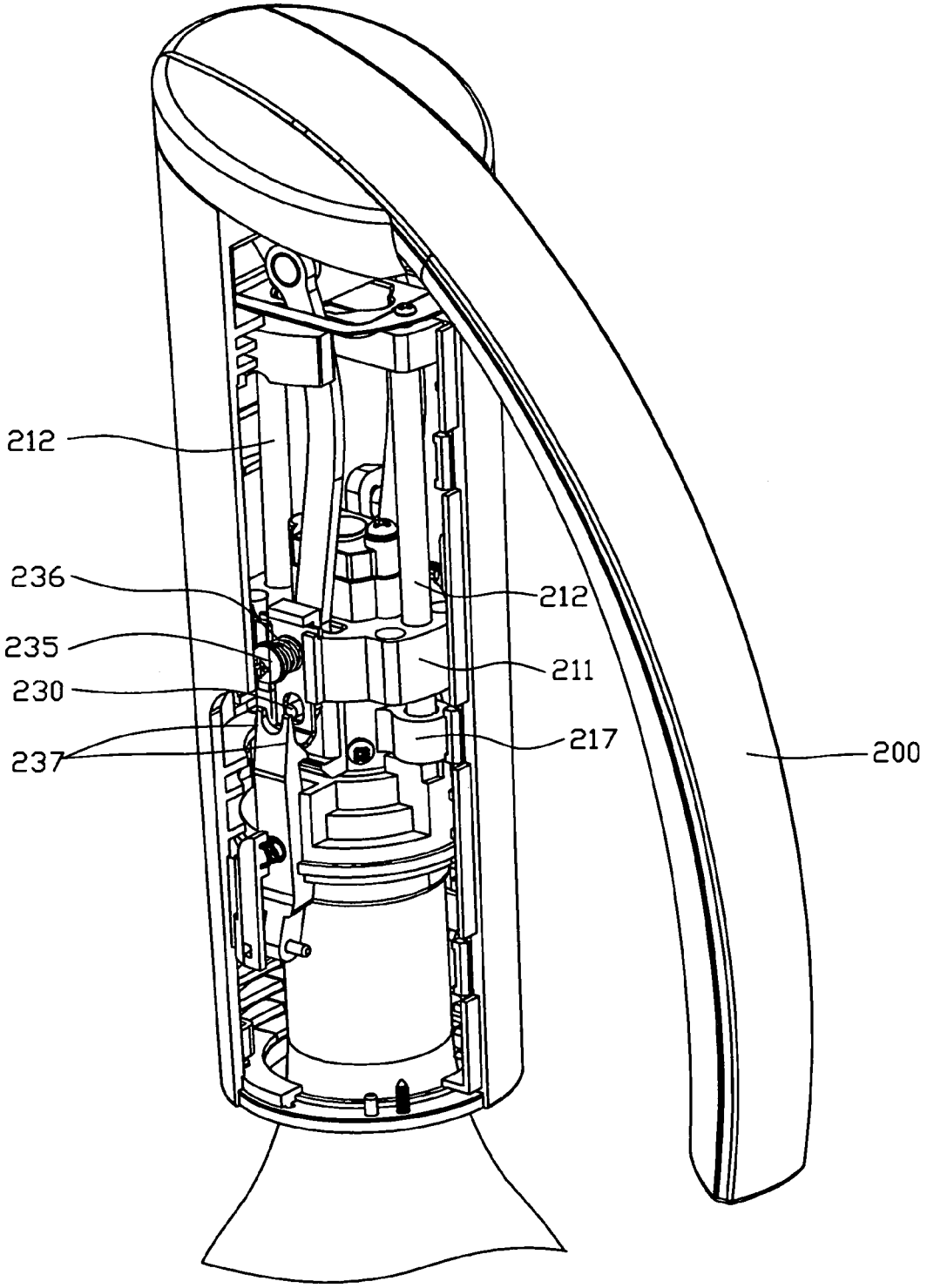
Figure 21:
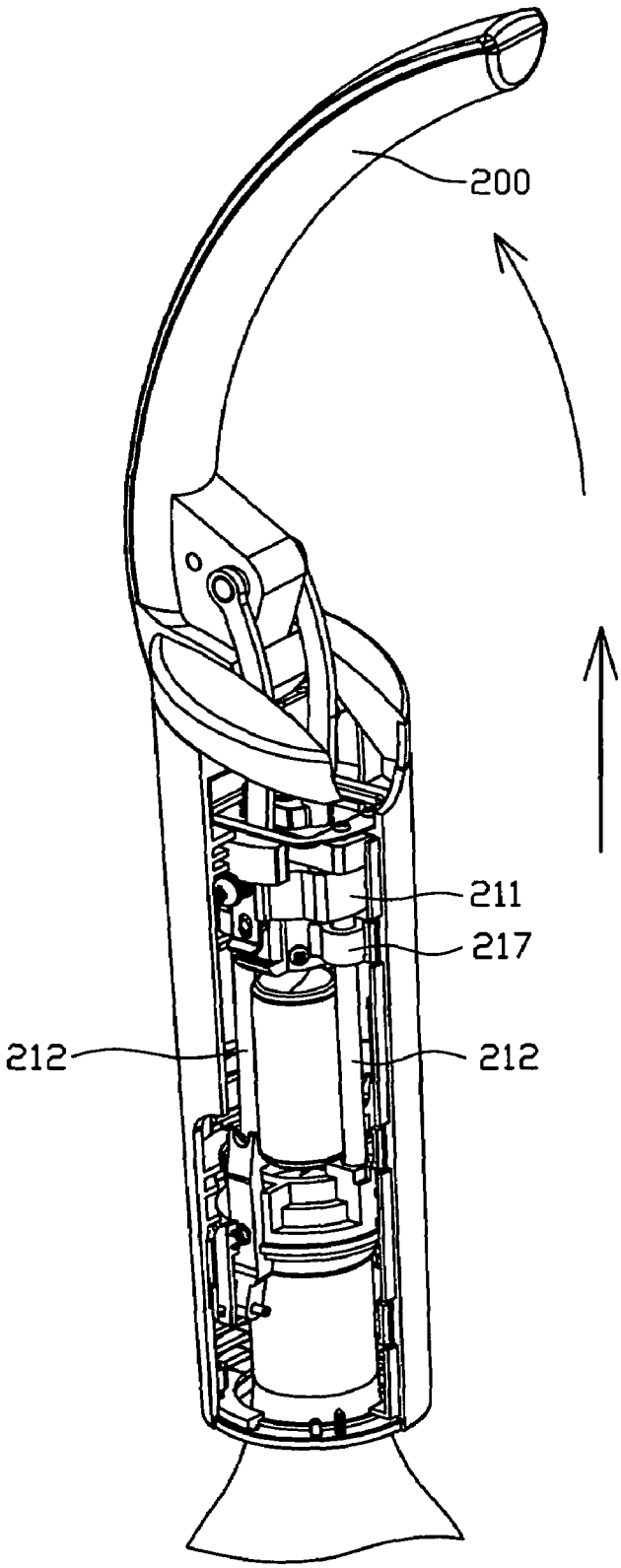
Figure 22:
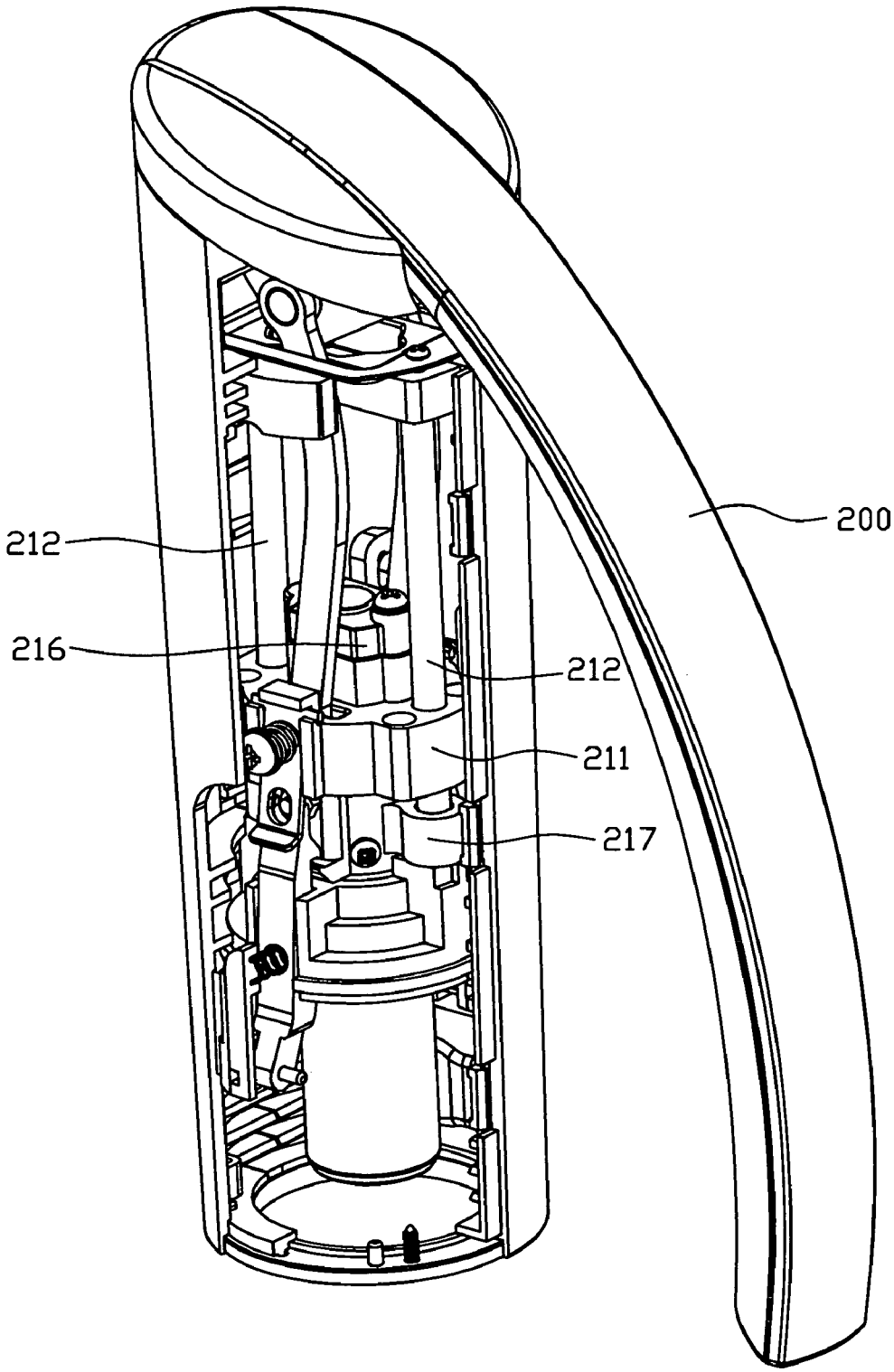
Figure 23:
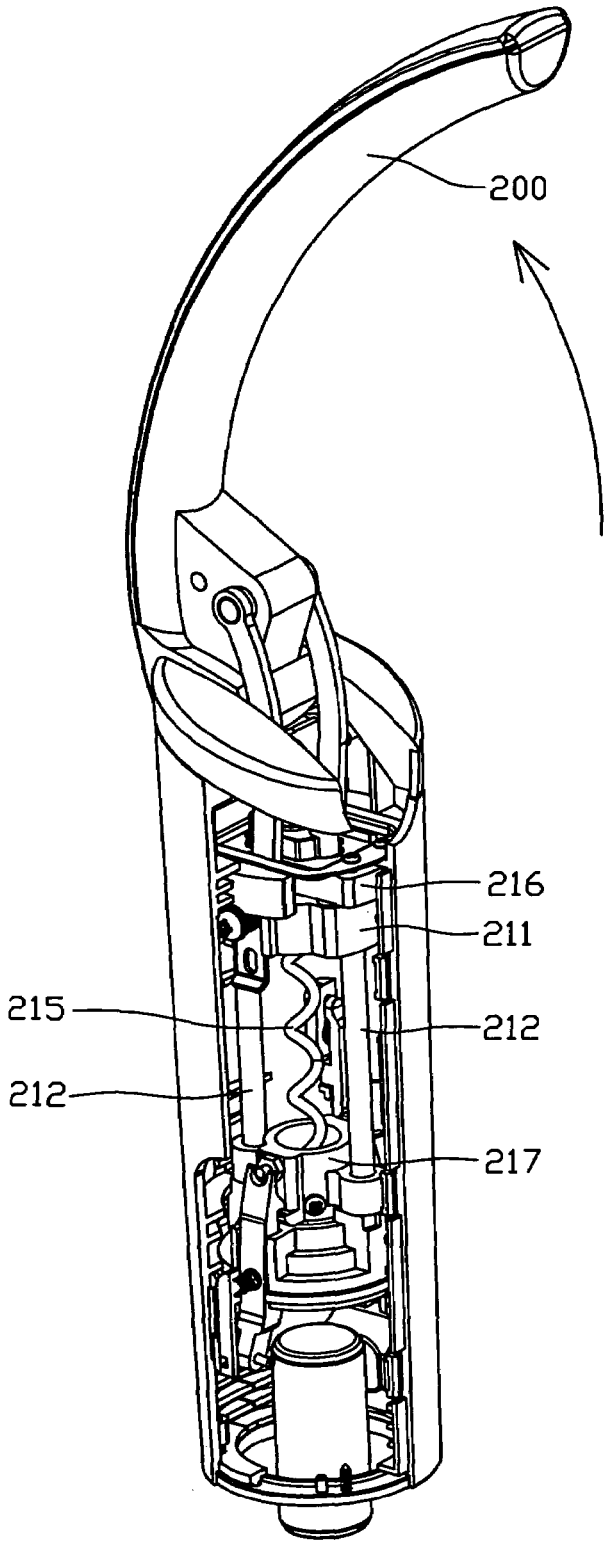
Figure 24:
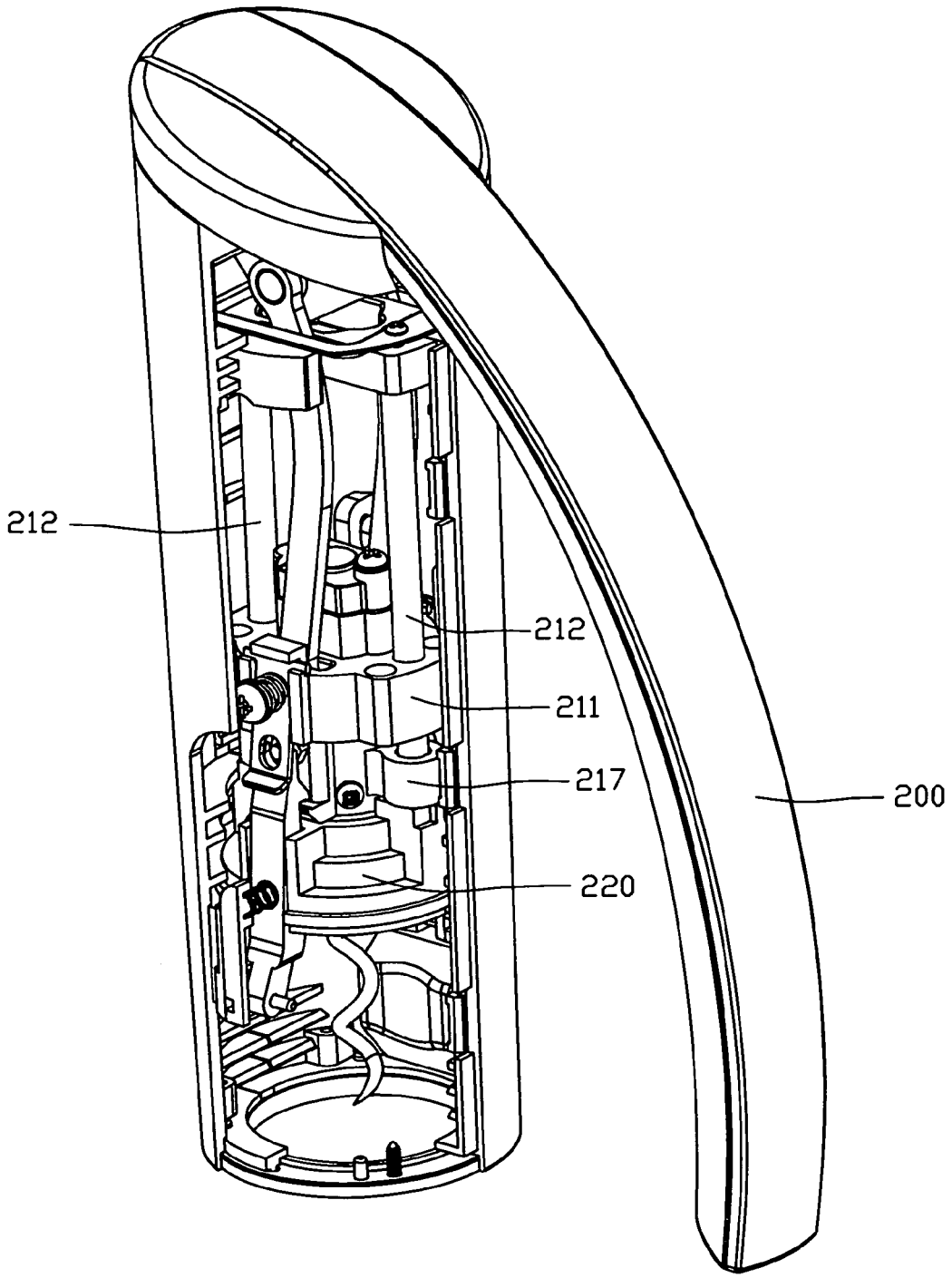
Figure 25:
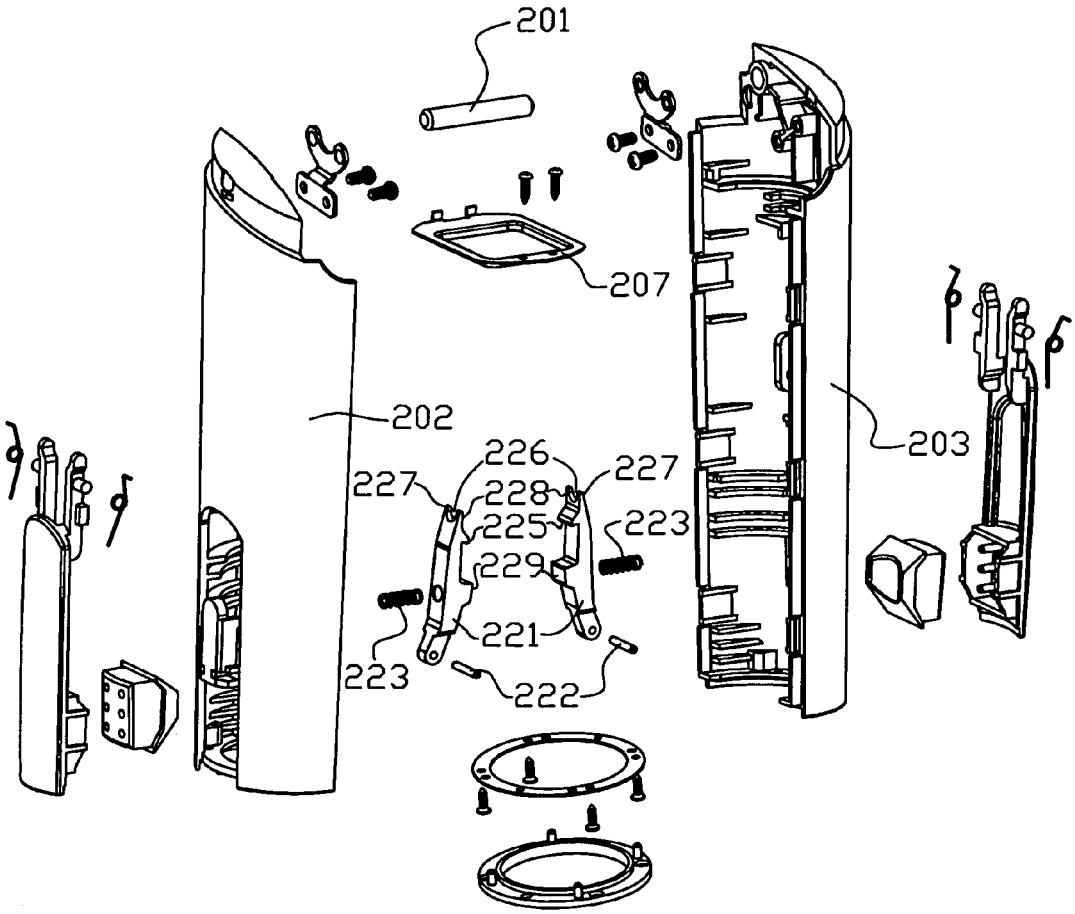
FIG. 25 is an exploded view of components of the third corkscrew.
Figure 26:
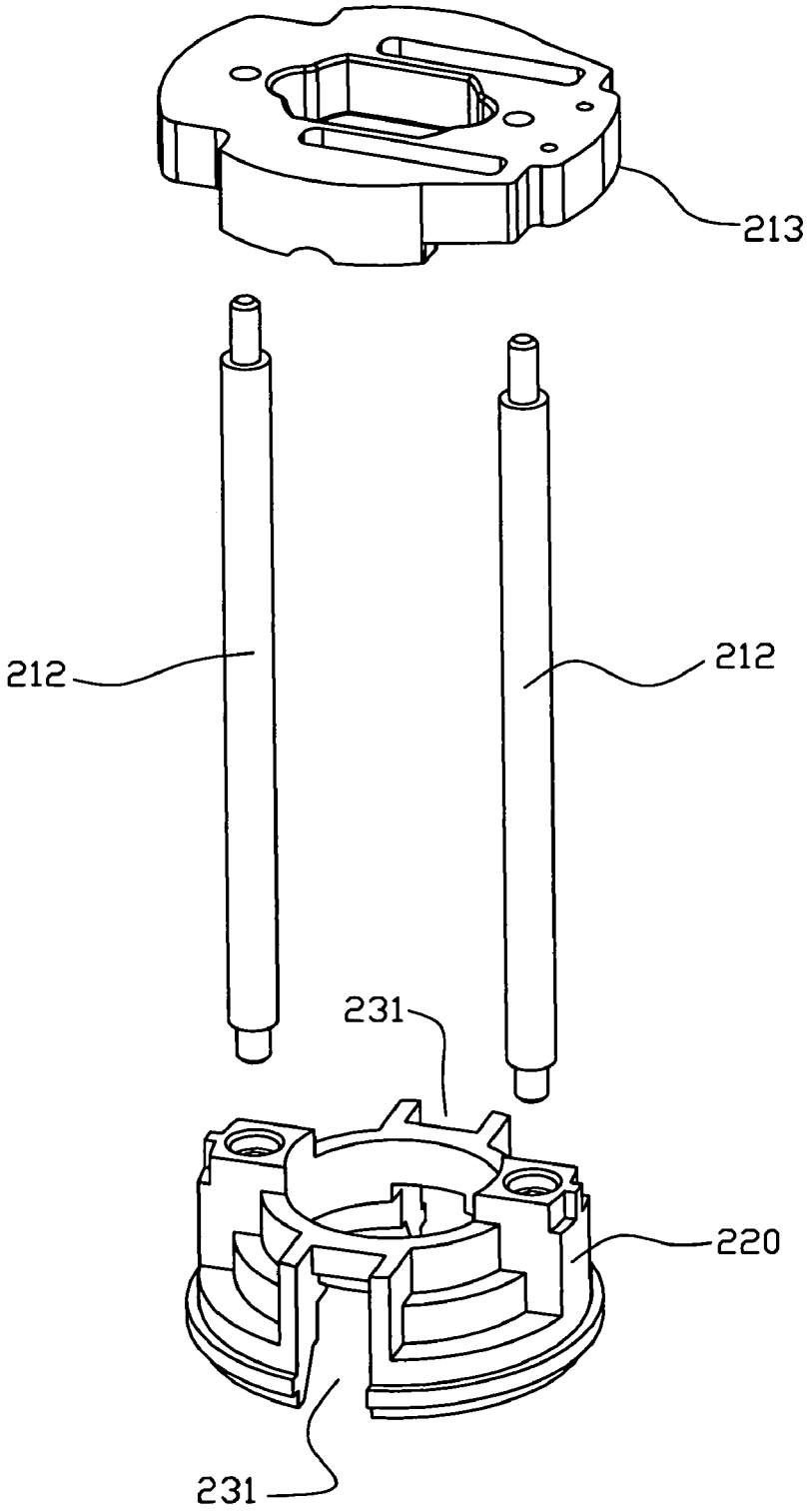
FIG. 26 illustrates the neck engaging member runners and platform of the third corkscrew.
Figure 27:
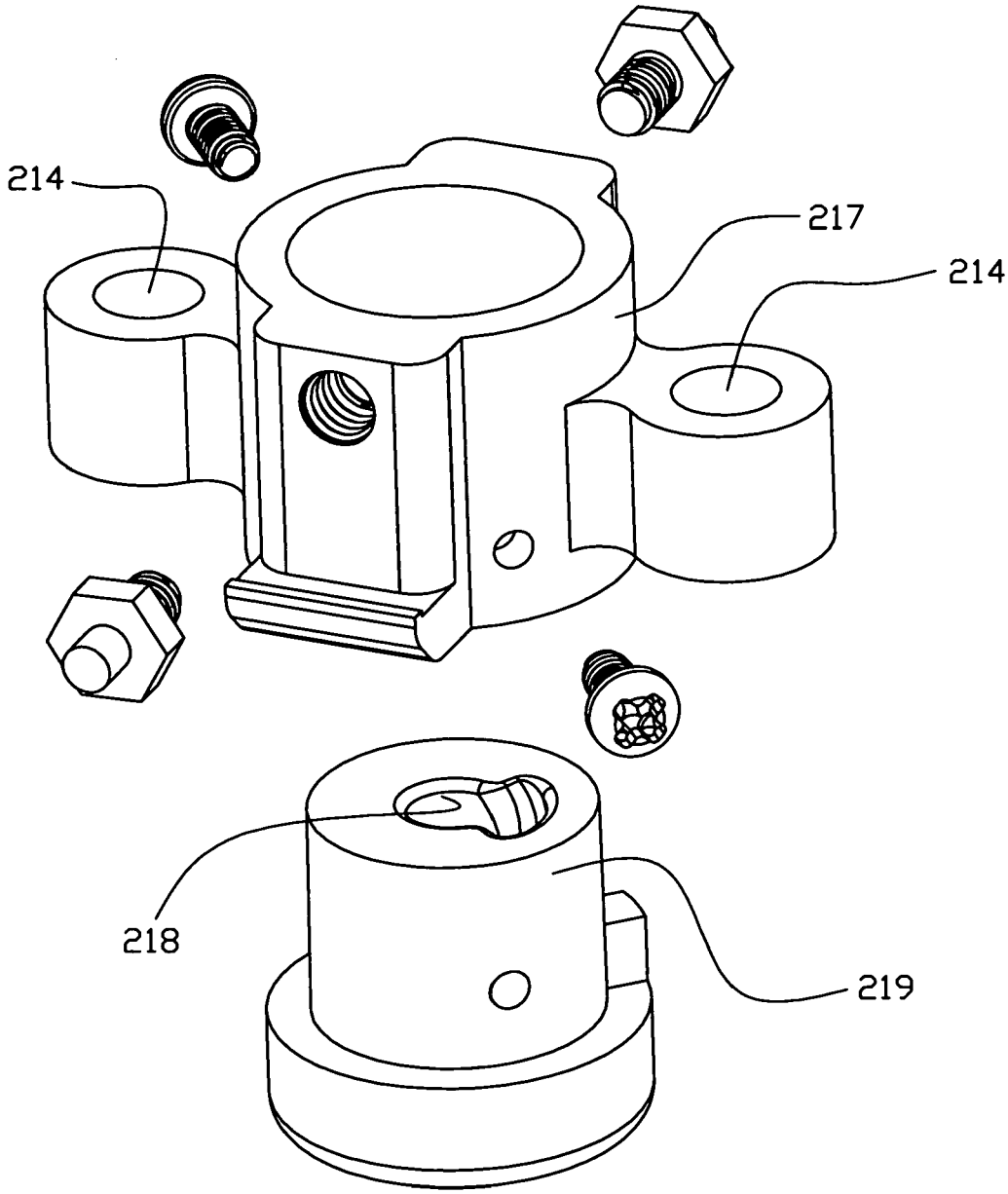
FIG. 27 illustrates the guide sleeve and guide member of the third corkscrew.
Figure 28:
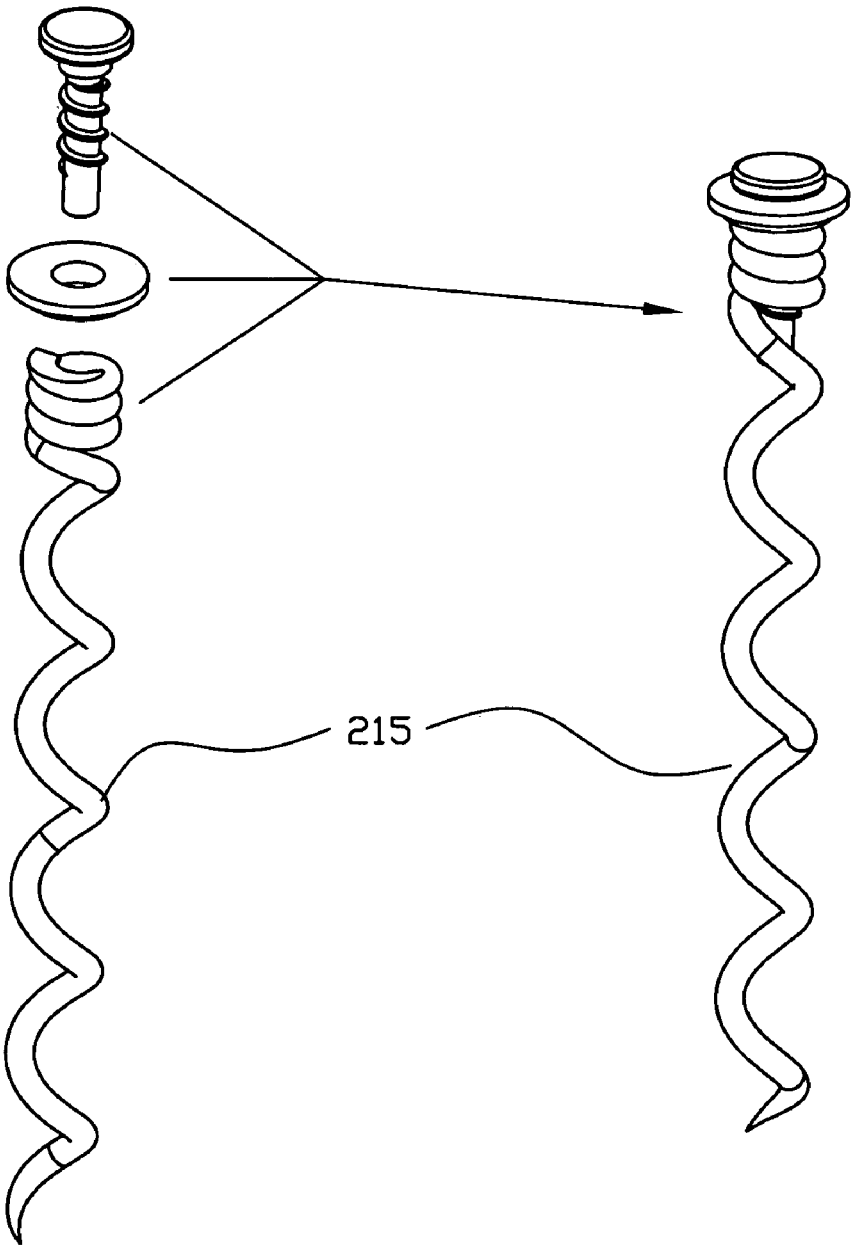
FIG. 28 shows the spiral screw of the corkscrew.
Figure 29:
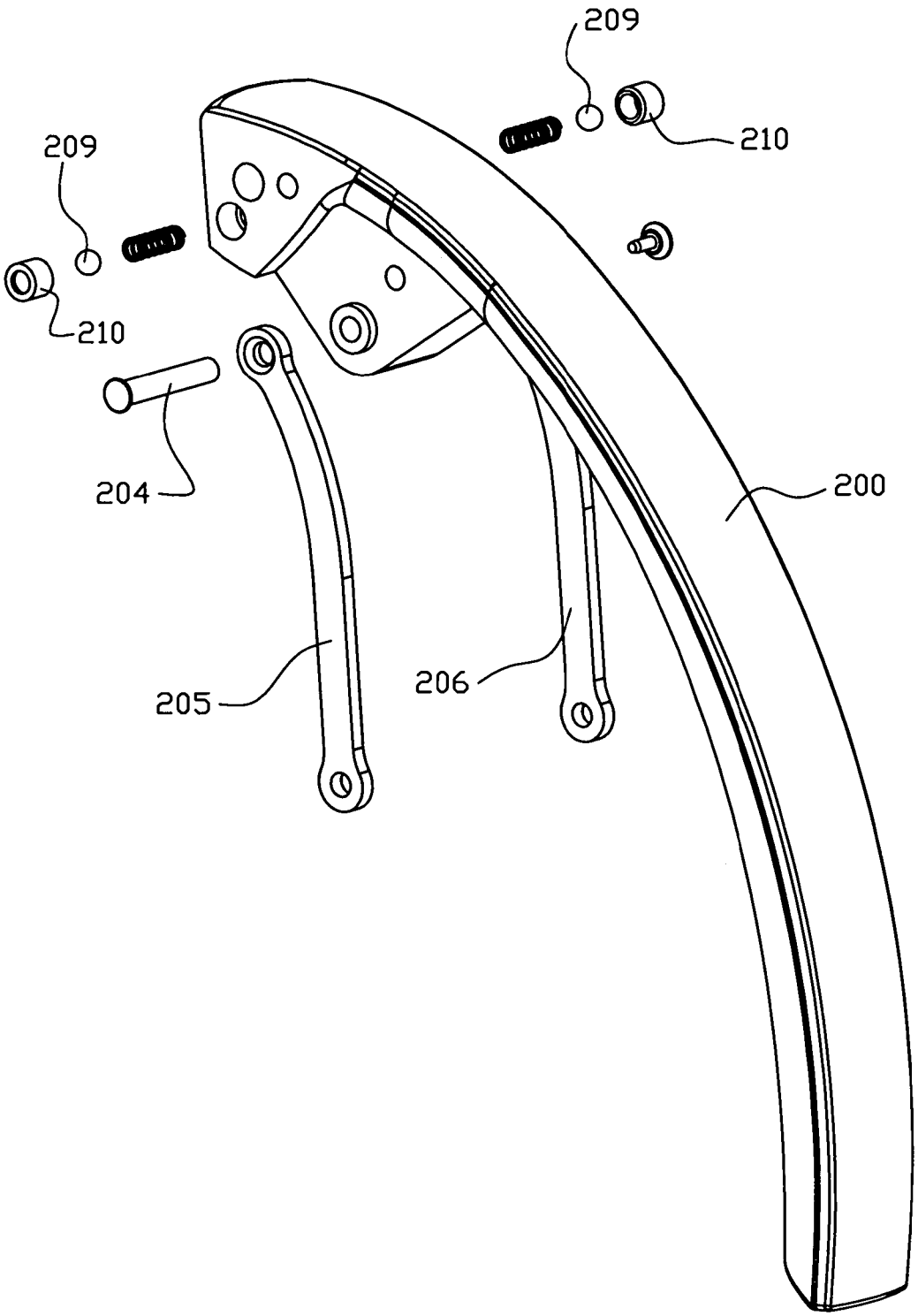
FIG. 29 illustrates the handle and bow shaped arms of the third corkscrew.

The stages in the operation of the corkscrew are illustrated in FIGS. 17 to 24. In FIG. 17 the handle of the corkscrew is lowered so that the carriage and guideway are in their lower position. The first latch member 221 is biassed inwardly by spring 223 so that the guide member 217 is locked in the lower position. The upper part of the first latch member forms a tongue comprising two upwardly extending tines 237 of FIGS. 18 and 20 with a U-shaped rebate between the tines. The rebate is dimensioned to snugly receive the pin 230 which extends radially outwardly from guide member 217. The second latch member 232 is prevented by the tongue from engaging the pin 230, the flange 234 being deflected outwardly against the action of the spring 236. Raising of the handle as shown in FIG. 18 causes the carriage 211 to be raised so that the spiral 215 is forced to rotate by passage through the helical bore in the guideway 217. The guideway 217 is retained in the lower position by engagement with the hook 225 of the first latch member. The corkscrew may then be inserted into the neck of a bottle as shown in FIG. 19. Lowering of the handle urges the spiral to rotate into the cork. The carriage 211 descends along the runners 212. The neck of the bottle contacts the shoulders or cam surfaces 229 of the first latch member urging the latter radially outwardly within the channel 231 of the neck engaging member 220. Thus when the carriage 211 and the second latch member 232 reach their lower position the flange 234 allows the second latch member 232 to pass over the head of pin 230 until the aperture 233 passes over the head of the pin. At this stage the spring 236 causes the second latch member 232 to engage the pin so that raising of the handle causes the carriage 211 and guide member 217 to move upwardly together creating rotation of the spiral as the cork is withdrawn from the bottle as shown in FIG. 21. The bottle is then removed from the socket of the corkscrew allowing the first latch members to move inwardly under the action of springs 223. Subsequent lowering of the handle causes the carriage 217 to be engaged by hook 225. The flange 234 urges the second latch member 232 outwardly preventing engagement with the pin 230. Subsequent raising of the handle as shown in FIG. 23 withdraws the spiral from the cork allowing the cork to fall freely.

I claim:

1. A corkscrew comprising a body, the body including a socket adapted to receive the neck of a bottle sealed by a cork, an actuation lever, an axially rotatable worm spiral mounted on a carriage within the body and arranged to rotate and penetrate the cork as the lever is lowered, the spiral being further arranged to cease rotation as the lever is raised to withdraw the cork from the bottle, the corkscrew being further arranged to discharge the cork from the spiral by lowering and raising the lever after the neck of the bottle has been removed from the socket;

wherein the carriage is mounted for movement between upper and lower positions along at least one or guide runners extending longitudinally of the body, the spiral being rotatably connected to the carriage so that the spiral can rotate with respect to the carriage, and further comprising a guide member having an aperture, the spiral extending through the aperture, the aperture being adapted to cause the spiral to rotate as the spiral moves axially through the guide member, first latch means being adapted to releasably engage the guide member to the corkscrew body, and second latch means being adapted to releasably engage the guide member to the carriage, the first latch member being moveable from a closed position to an open position by insertion of a bottle neck into the socket, wherein in the closed position the first latch member may engage the guide member and wherein in the open position the first latch member disengages the guide member, and wherein the first latch member in the closed position can prevent engagement of the second latch member to the guide member.

2. A corkscrew as claimed in claim 1 wherein the aperture includes a helical threaded bore adapted to receive the spiral, permitting the spiral to rotate as the guide member moves axially relative to the spiral.

3. A corkscrew as claimed in claim 1 wherein the first latch is actuated by insertion of the neck of a bottle into the socket.

4. A corkscrew as claimed in claim 1 wherein when the first latch is disengaged, the guide member and carriage may move together to withdraw a cork from the bottle.

5. A corkscrew as claimed in claim 1 wherein when the opened bottle is removed from the socket, the first latch may engage the guide member to prevent further movement when it is moved to the lower position.

6. A corkscrew as claimed in claim 1 wherein the second latch means is released by the first latch means.

7. A corkscrew as claimed in claim 6 wherein when the first latch is in the open position, the second latch can engage the guide member.

8. A corkscrew as claimed in claim 1 wherein the first latch member includes a projection with a downwardly facing restraining surface.

9. A corkscrew as claimed in claim 1 wherein the second latch member is elongate in the longitudinal direction.

10. A corkscrew as claimed in claim 9 wherein the second latch member is mounted on a pivot on the carriage, the lower end being urged inwardly by a spring.

11. A corkscrew as claimed in claim 9 wherein a lower portion of the second latch member is adapted to engage and cooperate with a complementary surface of the first latch member.

12. A corkscrew as claimed in claim 1 wherein the second latch member comprises a plate having an aperture adapted to receive and engage a projection, pin or lug extending outwardly from the guide member.

13. A corkscrew as claimed in claim 1 including gripping means adapted to move inwardly when grasped by a user to engage and prevent movement of the neck of a bottle received in the socket.

14. A corkscrew as claimed in claim 13 wherein the gripping means comprise a pair of arms pivotally mounted on the body.

15. A corkscrew as claimed in claim 14 wherein the gripping means carry bottle engaging pads.

* * * * *